US007154457B2

(12) United States Patent
Sagano et al.

(10) Patent No.: US 7,154,457 B2
(45) Date of Patent: Dec. 26, 2006

(54) IMAGE DISPLAY APPARATUS

(75) Inventors: Osamu Sagano, Tokyo (JP); Naoto Abe, Tokyo (JP); Hiroshi Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1073 days.

(21) Appl. No.: 10/166,641

(22) Filed: Jun. 12, 2002

(65) Prior Publication Data

US 2003/0011545 A1 Jan. 16, 2003

(30) Foreign Application Priority Data

Jun. 14, 2001 (JP) ..... 2001-180897
Jul. 31, 2001 (JP) ..... 2001-232594

(51) Int. Cl.
*G09G 3/30* (2006.01)
*G09G 5/10* (2006.01)

(52) U.S. Cl. ..... 345/78; 345/75; 345/77; 345/690; 345/214

(58) Field of Classification Search ..... 345/75, 345/76, 77, 78, 87, 89, 214, 690
See application file for complete search history.

(56) References Cited

U.S. PATENT DOCUMENTS 5,734,361 A 3/1998 Suzuki et al. ..... 345/74
6,549,182 B1 * 4/2003 Nitta et al. ..... 345/89
6,700,559 B1 3/2004 Tanaka et al. ..... 345/88
6,707,437 B1 * 3/2004 Kuno et al. ..... 345/74.1
6,985,141 B1 * 1/2006 Abe et al. ..... 345/204
2002/0089473 A1 7/2002 Yamazaki et al. ..... 345/75.2

FOREIGN PATENT DOCUMENTS

| | | |
|---|---|---|
| JP | 63-213084 | 9/1988 |
| JP | 2-257553 | 10/1990 |
| JP | 8-248920 | 9/1996 |
| JP | 9-134145 | 5/1997 |
| JP | 2000-242208 | 9/2000 |
| JP | 2001-112015 | 4/2001 |
| JP | 2002/221933 | 8/2002 |

* cited by examiner

*Primary Examiner*—Dennis-Doon Chow
(74) *Attorney, Agent, or Firm*—Fitzpatrick, Cella, Harper & Scinto

(57) ABSTRACT

The invention provides an image display apparatus and an image display method of excellent image quality, by correcting the voltage drop retsulting from the electrical resistance of the wirings with a simple configuration.

There are provided adjustment data calculation means for calculating, for input image data, adjustmnent data for correcting the influence of the voltage drop resulting from the electrical resistance of the row wirings and gray scale number converting means for converting the number of gradation levels of the adjustmnent data. Modulation means outputs a signal modulated in the voltage amplitude to each column wiring, based on the adjustment data outputted by and subjected to the conversion of gradation levels by the gray scale number converting means.

12 Claims, 20 Drawing Sheets

EMISSION CURRENT PULSE WHEN NO VOLTAGE DROP TAKES PLACE

ACTUAL EMISSION CURRENT PULSE

ADJUSTED EMISSION CURRENT PULSE

※ IE : EMISSION CURRENT WHEN NO VOLTAGE DROP TAKES PLACE

EMISSION CURRENT PULSE WHEN NO VOLTAGE DROP TAKES PLACE

ACTUAL EMISSION CURRENT PULSE

ADJUSTED EMISSION CURRENT PULSE $$CA=((Xn+1-x)*CData[k][n]+(x-Xn)*CData[k][n+1])/(Xn+1-Xn)$$

$$CB=((Xn+1-x)*CData[k+1][n]+(x-Xn)*CData[k+1][n+1])/(Xn+1-Xn)$$

$$CD=CA*(Dk+1-data)+CB*(data-Dk)/(Dk+1-Dk)$$

2×2 DITHERING TABLE
EXAMPLE OF Bayer Matrix

Q [1:0] = 0 WHERE, H=0, V=0
2 WHERE, H=1, V=0
3 WHERE, H=0, V=1
1 WHERE, H=1, V=1

IMAGE DISPLAY APPARATUS

BACKGROUND OF THE INVENTION

1. Field of the Invention

The present invention relates to an image display apparatus provided with image forming devices arranged in a matrix, and more particularly to a signal processing unit which is applicable to a television receiver or a display apparatus, utilizing a display panel provided with plural surface conduction devices wired in a matrix and a phosphor plate for emitting light by receiving the irradiation of electron beams from such surface conduction devices and adapted to display an image by receiving a television signal or a display signal from a computer, and which is composed of image data adjustment means for adjusting the drop in the drive voltage resulting from the electrical resistance in the matrix wirings of the aforementioned display panel and gray scale number conversion means for converting the number of gradation levels of the image data or the adjustment data.

2. Related Background Art

Within such image display apparatus, the Japanese Patent Application Laid-open No. 8-248920 discloses an image display apparatus having a configuration, in order to adjust the luminance loss resulting from the voltage drop in the wiring resistance such as the wirings for electrical connection to the electron emitting devices, of calculating adjustmnent data by statistical calculation and synthesizing the requested value of the electron beam and the adjustment value.

FIG. 18 is a schematic block diagram showing the configuration of an image display apparatus of conventional technology.

In the following there will be explained the configuration relating to the data adjustment.

At first luminance data of a line of digital image signal are added in an adder 206, and adjustment rate data corresponding to the added value are read from a memory 207. On the other hand, the digital image signal is subjected to serial/parallel conversion in a shift register 204, then held for a predetermined time in a latch circuit 205 and entered at predetermined timings into multipliers 208 provided respectively in the column wirings.

For each column wiring, the multiplier 208 multiplies the luminance data with the adjustment data read from the memory 207, and the obtained data after adjustment are transferred to a modulation signal generator 209 to generate a modulation signal corresponding to the adjusted data, whereby an image displayed on the display panel based on such modulation signal.

As explained in the foregoing, there is executed a statistical calculation on the digital image signal such as the calculation of sum or average, such as the addition calculation of the luminance data of a line of the digital luminance data in the adder 206, and the adjustment is executed based on the result of such statistical calculation.

On the other hand, in the dither processing for the image signal, it is already known to obtain a multi-value image signal by a dither matrix, as disclosed in the Japanese Patent Application Laid-open No. 63-213084.

However, in such conventional configurations, there is required a hardware of a large magnitude such as multipliers respectively for the column wirings, a memory for supplying the adjustment data and an adder for providing the memory with address signals.

Also there has been a drawback that such adjustment involves discarding of bits of the digital data, thereby resulting in deterioration of the gradation of the image.

SUMMARY OF THE INVENTION

In consideration of the foregoing, the object of the present invention is to provide an image display apparatus and an image display method capable of adjusting the voltage drop resulting from the electrical resistance of the wirings with a simple configuration while maintaining excellent image quality.

The above-mentioned object can be attained, according to the present invention, by an image display apparatus provided with:

plural image forming devices arranged in a it matrix and connected to plural row wirings and plural column wirings;

scanning means connected to the row wirings and adapted for scanning the row wirings in succession; and modulation means connected to the column wirings, the apparatus being firstly featured in comprising:

adjusted image data calculation means for calculating adjusted image data which are image data adjusted for the input image data;

wherein the adjusted image data calculation means is adapted to calculate the adjusted image data having a smooth distribution in the horizontal or vertical direction of the image for same non-zero image data input; and gray scale number conversion means for converting the number of gradation levels of the adjusted image data outputted by the adjusted image data calculation means;

wherein the modulation means outputs a modulated voltage signal to each column wiring based on the adjusted image data converted by the gray scale number conversion means.

According to the present invention, there is also provided an image display apparatus provided with:

plural image forming devices arranged in a matrix and connected to plural row wirings and plural column wirings;

scanning means connected to the row wirings and adapted for scanning the row wirings in succession; and modulation means connected to the column wirings, the apparatus being secondly featured in comprising:

adjusted image data calculation means for calculating adjustment data having a smooth distribution in the horizontal or vertical direction of the image for same non-zero image data input;

gray scale number conversion means for converting the number of gradation levels of the adjusted image data; and addition means for adding the adjustment data subjected to the conversion of gradation levels and the input image data;

wherein the modulation means outputs a modulated voltage signal to each column wiring based on the output of the addition means.

DESCRIPTION OF THE PREFERRED EMBODIMENTS

Now the present invention will be clarified in detail by preferred embodiments thereof with reference to accompanying drawings, taking an image display apparatus employing surface conduction emission devices (hereinafter represented as SCE)

First Embodiment

In the following there will be explained an image display apparatus constituting a first embodiment, with reference to the accompanying drawings.

At first there will be explained the external view of a display panel to be used in the image display apparatus embodying the present invention, electrical connections of the display panel, and the characteristics of SCE.

The image display apparatus has a configuration of simple matrix display consisting of a scanning circuit for line-sequentially scanning row electrodes and pulse width, modulation means for varying the pulse width of output voltages to column electrodes. In the following a row wiring may also be called a scanning wiring and a column wiring may also be called a modulation wiring.

(Outline of Image Display Apparatus)

Figure 2:
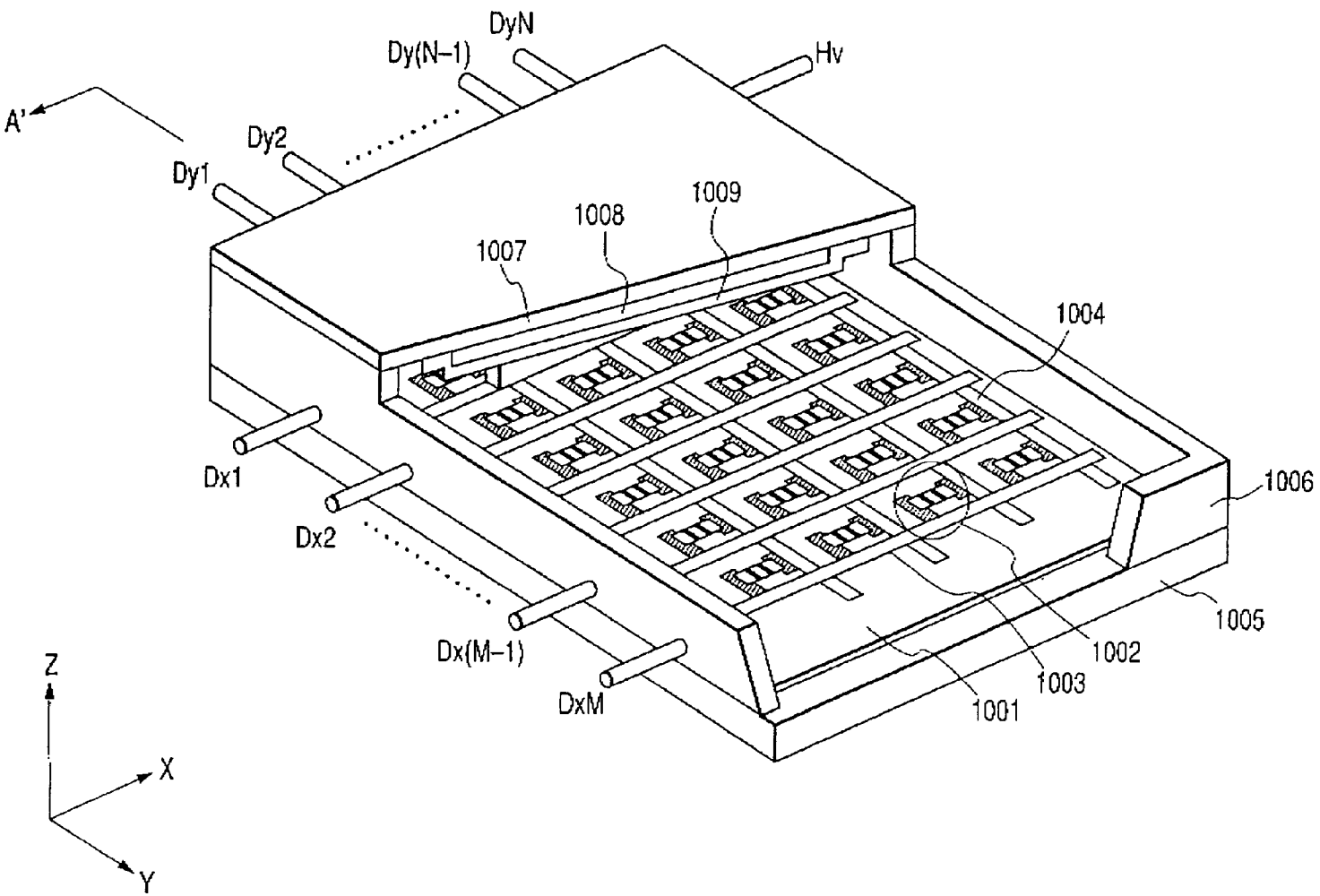
FIG. 2 is a perspective view of an image display apparatus embodying the present invention.

FIG. 2 is a perspective view of an image display apparatus (display panel) embodying the present: invention, wherein a part of the panel is cut off for showing the internal structure.

In FIG. 2, there are shown a rear plate 1005, a lateral wall 1006 and a face plate 1007 which constitute a hermetic container for maintaining the interior of the display panel in vacuum state.

Figure 3:
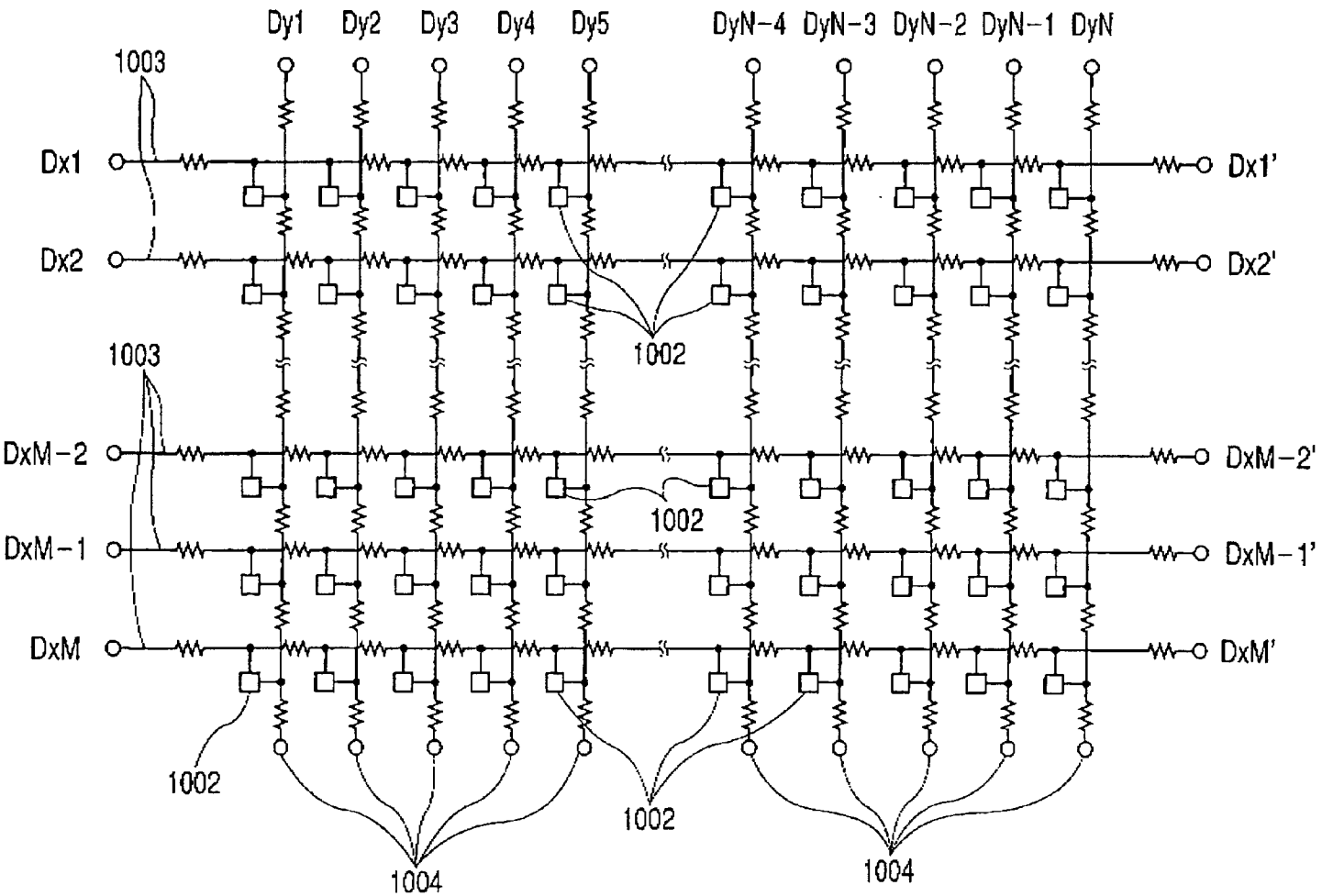
FIG. 3 is a schematic plan view showing the wirings of display devices.

On the rear plate 1005 there is fixed an device substrate 1001 bearing thereon SCE 1002, constituting image forming devices, in a number N×M. The row wirings 1003, column wirings 1004 and SCE's are connected as shown in FIG. 3.

The unit constituted by the substrate 1001, SCE 1002, row wirings 1003 and column wirings 1004 is called a multi electron source.

On the lower face of the face plate 1007, phosphors 1008 of three primary colors of red, green and blue are formed respectively corresponding to the respective pixels.

On the lower face of the phosphor film 1008, there is formed a metal back 1009, and a high voltage is applied to an Hv terminal electrically connected to the metal back 1009 to apply the high voltage between the rear plate and the face plate.

(Characteristics of SCE)

Figure 4:
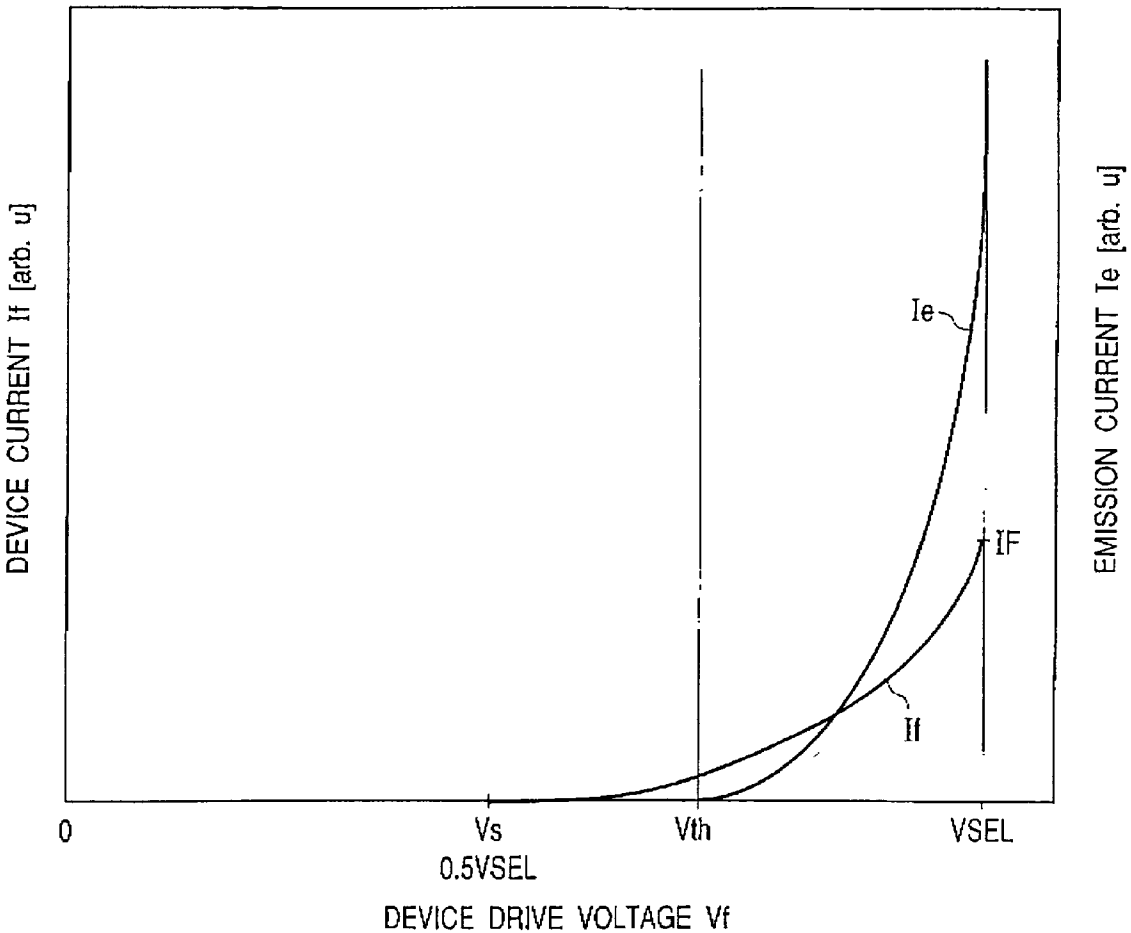
FIG. 4 is a characteristic chart of a surface conduction electron-emitting device.

The SCE has, as shown in FIG. 4, (emission current Ie) vs. (device drive voltage Vf) characteristics and (device current If) vs. (device drive voltage Vf) characteristics. Since the emission current Ie is significantly smaller than the device current If and cannot be represented on a same scale, the two curves are shown in respectively different scales.

The device has following three characteristics with respect to the emission current Ie.

Firstly, the emission current Ie rapidly increases by the application of a voltage equal to or higher than a threshold voltage Vth, but the emission current Ie is scarcely detected at an applied voltage less than the threshold value Vth.

Secondly, as the emission current Ie varies depending on the voltage Vf applied to the device, the magnitude of the emission current Ie can be controlled by varying the voltage Vf.

Thirdly, as the SCE has high-speed response, the emission time of the emission current Ie can be controlled by the application time of the voltage Vf.

In the image display apparatus employing the display panel shown in FIG. 2, the first characteristics can be utilized to achieve simple matrix display by supplying a selected device with a suitable voltage exceeding the threshold value Vth corresponding to the desired light emission luminance while supplying a non-selected device with a voltage less than the threshold value Vth and scanning the devices in succession.

Also the second characteristics can be utilized to control the light emission luminance of phosphor by modulating the voltage Vf applied to the device, thereby achieving gradational display by amplitude modulation.

Also the third characteristics can be utilized to control the light emission time of the phosphor by modulating the application time of the voltage Vf to the device, thereby achieving gradational display by pulse width modulation (PWM).

(Drive Method of Display Panel)

Figure 5:
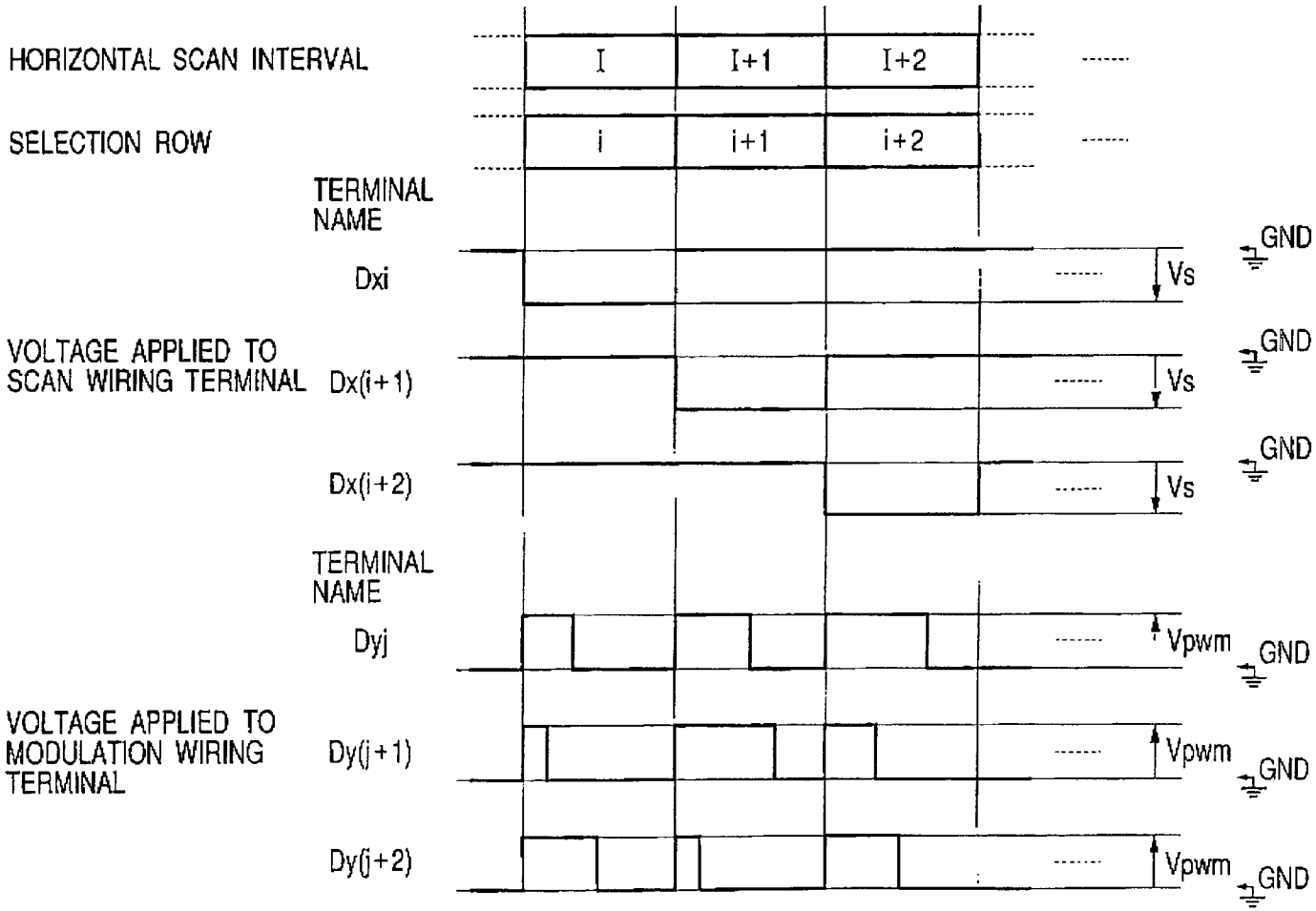
FIG. 5 is a view showing the drive method for a display panel.

FIG. 5 shows an example of voltages applied to voltage supply terminals of scanning wirings and modulation wirings in driving the display panel of the present invention.

A horizontal scanning period I is assumed to be a period for light emission from the pixels of an i-th row.

For light emission from the pixels of i-th row, the scanning wiring of the i-th row is placed in a selected state by applying a selection voltage Vs to the voltage supply terminal Dxi thereof. The voltage supply terminals Dxk of other scanning wirings (k=1, 2, . . . , N but k≠i.) are placed in a non-selected state by application of a non-selecting voltage Vxs.

In the present embodiment, the selecting voltage Vs is selected at $-0.5\ V_{SEL}$ which is a half of the voltage $V_{SEL}$ shown in FIG. 4, and the non-selecting voltage is selected at the ground voltage GND.

Also the voltage supply terminal of the modulating wirings is given a pulse width modulated signal of a voltage amplitude Vpwm. In the conventional case without adjustment, the pulse width of the pulse width modulated signal supplied to a j-th modulation wiring is determined according to the magnitude of the image data for a pixel of i-th row and j-th column in the image to be displayed, and all the modulation wirings are given pulse width modulate signals corresponding to the magnitudes of the image data of the respective pixels.

In the present embodiment, as will be explained later in sore details, the pulse width of the pulse width modulated signal supplied to a j-th modulation wiring is determined according to the magnitude of the image data for a pixel of i-th row and j-th column in the image to be displayed and also to a corresponding adjustment amount in order to compensate the loss in the luminance resulting front the voltage drop, and all the modulation wirings are given pulse width modulated signals.

In the present embodiment, the voltage Vpwm is selected at $+0.5\ V_{SEL}$.

(Voltage Drop in the Scanning Wiring)

As explained in the foregoing, the issue to be resolved in the present invention is an increase in the potential on the scanning wirings resulting from the voltage drop in the scanning wiring of the display panel and decreasing the voltage applied to the SCE, thereby reducing the emission current from the SCE. In the following there will be explained the mechanism of such voltage drop.

Though variable depending on the design specifications and the producing method of the SCE, the device current of a SCE device is about several hundred microampere under the application of the voltage $V_{SEL}$.

Thus, in case of causing only one pixel to emit light and no light emission from other pixels within the selected scanning line in a certain horizontal scanning period, the device current flowing from the modulation wirings to the scanning wiring of the selected row is limited to the current of one pixel (namely several hundred microampere mentioned above). Therefore, the voltage drop is scarcely generated and the luminance of the emitted light is not lowered.

On the other hand, in case of light emission from all the pixels of the selected row in a certain horizontal scanning period, there flows a current corresponding to al the pixels from all the modulation wirings to the selecting wiring in the selected state, whereby the total current reaches several hundred miniamperes to several amperes to generate a voltage on the scanning wiring by the wiring resistance thereof.

Such voltage drop on the scanning wiring results in a loss of the voltage applied across the SCE, whereby the emission current of the SCE for light emission is lowered to reduce the luminance of the emitted light.

Such phenomenon is further complicated by a fact that the magnitude of the voltage drop varies even within a horizontal scanning period in case the modulation is executed by pulse width modulation.

In case the signal supplied to each column is a pulse width modulation signal which has a synchronized start point and a pulse width variable depending on the magnitude of the input data as shown in FIG. 5, the number of turned-on pixels is generally larger in the initial portion of a horizontal scanning period and such turned-on pixels are successively turned off from the portions of lower luminance, so that the number of the turned-on pixels gradually decreases with time within a horizontal scanning period, though such tendency depends fin the input image data to a certain extent.

Consequently the magnitude of the voltage drop generated on the scanning wiring tends to be larger in the initial portion of a horizontal scanning period and to gradually decrease thereafter.

Since the pulse width modulation signal varies at each time corresponding to a gradation level of modulation, the voltage drop also varies at each time corresponding to a gradation level of the pulse width modulation signal.

In the foregoing, there has been explained the voltage drop in the scanning wiring, which is the basic issue to be solved in the present invention.

In the following there will be explained an adjustment method for the influence of the voltage drop, featuring the present invention.

(Method of Calculation of Voltage Drop)

In order to determine the adjustment around for reducing the influence of the voltage drop, there is at first required a hardware capable of estimating the magnitude of voltage drop and the change thereof in time on real-time basis. However, in the display panel to be used in such image display apparatus as contemplated in the present invention, there are usually provided several thousand modulation wirings, and it is extremely difficult to calculate the voltage drops at the crossing points of all the modulation wirings and the scanning wiring and not realistic to prepare a hardware capable of executing such calculation on real-time basis.

Therefore, the amount of voltage drop is determined by dividing the positions in a same row into blocks and also dividing the magnitude of the image data into blocks.

such block formation is based on the following characteristics of voltage drop:

i) At a certain point within a horizontal scanning period, the voltage drop generated on the scanning wiring is a spatially continuous amount on the scanning wiring and shows a very smooth curve; and ii) The magnitude of the voltage drop, though dependent on the image to be displayed, varies at each time corresponding to a gradational level of pulse width modulation and shows a general behavior of either being large at the starting portion of the pulse and gradually decreasing in time, or maintaining the magnitude in time. Stated differently, in the drive method as shown in FIG. 5, the magnitude of the voltage drop never increases within a horizontal scanning period.

More specifically, the change of the voltage drop in time is estimated in approximate manner by calculating the voltage drop by a degeneration model to be explained later for plural time.

(Calculation of Voltage Drop by Degeneration Model)

Figure 6A:
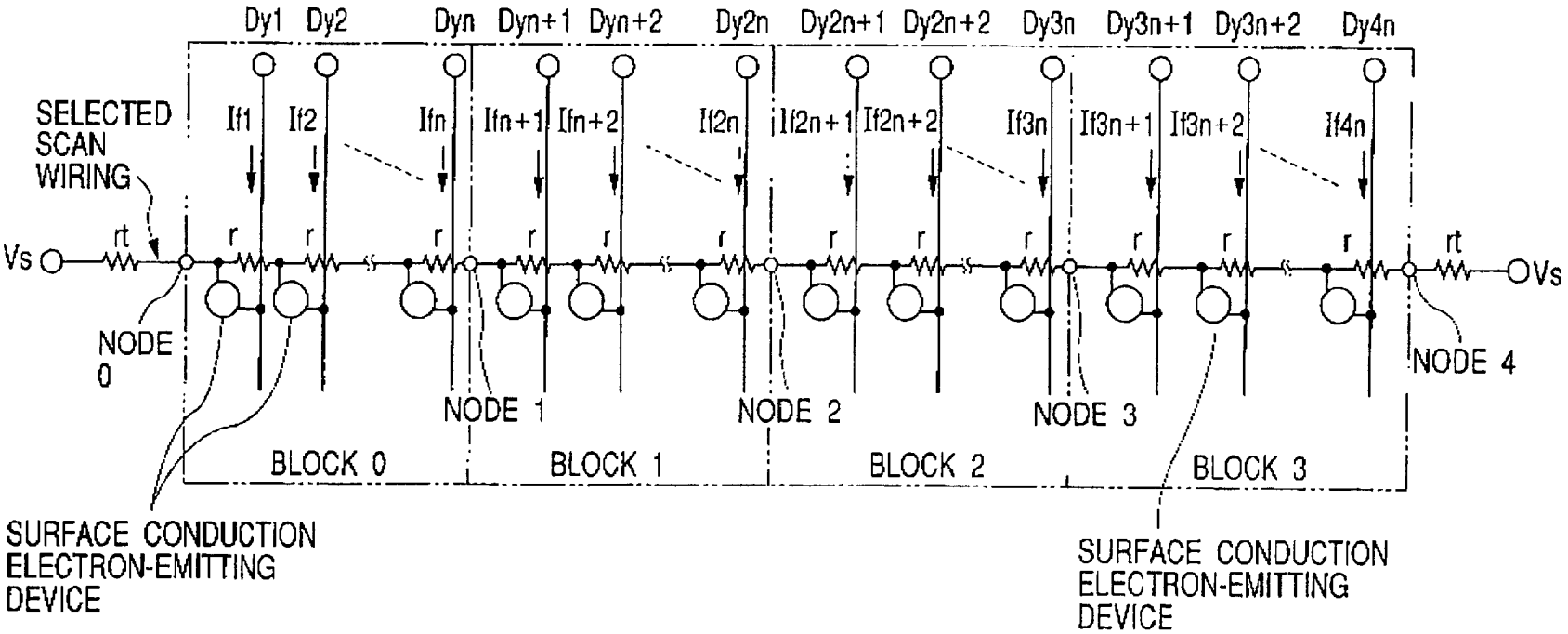
FIGS. 6A, 6B and 6C are views showing a degeneration model of an embodiment of the present invention.

FIG. 6A is a view showing blocks and nodes to be used in the degeneration of the present invention.

In FIG. 6A, for the purpose of simplification, there are only illustrated the selected scanning line, the modulation wirings and the SCE to be connected at the crossing points thereof.

It is now assumed that, at a certain time within a horizontal scanning period, the turn-on state (whether the output of the modulation means is "H" or "L") is known for each pixel on the selected scanning wiring.

In such turn-on state, the device current flowing from each modulation wiring to the selected scanning wiring is defined as Ifi (i=1, 2, . . . , N, representing column number).

Also as shown in FIG. 6A, a block is defined by a group of crossing points of n modulation wirings and the selected scanning wiring and SCE's positioned at such crossing points. In the present example, four blocks are formed by such block division.

Also at the boundary position of each block, there is defined a position called node. The node is a horizontal position (reference point) for calculating the amount of voltage drop generated on the same row in the degeneration model in discrete manner. Each divided block is composed of the SCE's connected to an area of the scanning wiring divided by the nodes (reference points).

In the present example, there are seL five nodes 0 to 5 at the boundary positions of the blocks.

Figure 6B:
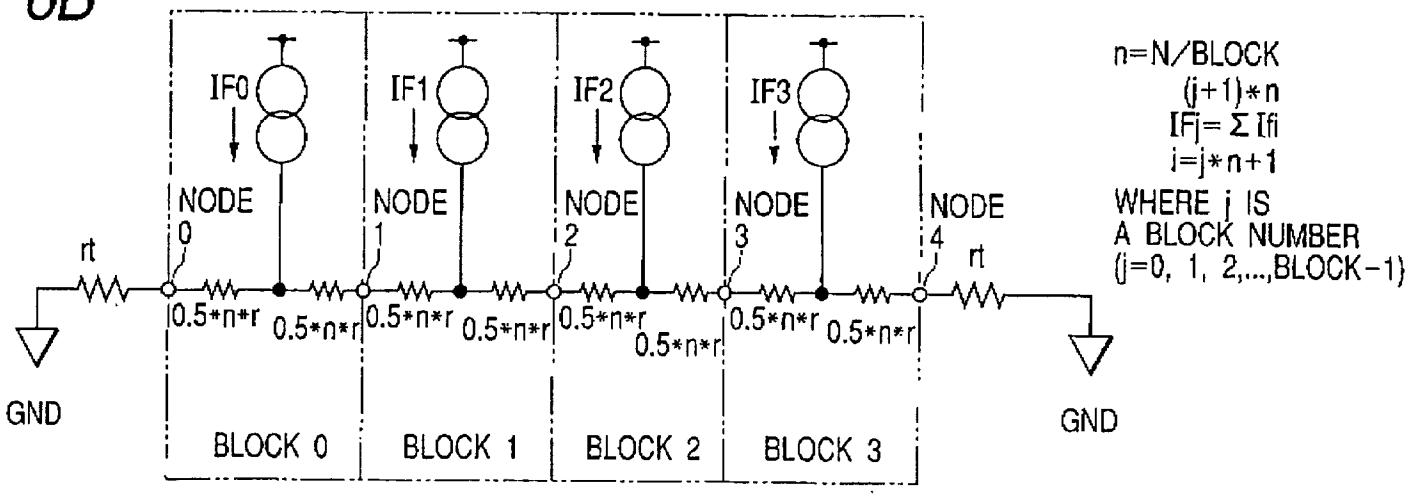

FIG. 6B shows a degeneration model.

In the degeneration model, in modulation wirings contained in a block shown in FIG. 6A are degenerated to a wiring, which is assumed to be connected at the center of a block of the scanning wiring.

It is also assumed that a current source is connected to the degenerated modulation wiring of each block, and that the summed currents (statistical amounts) IF0 to IF3 in the respective blocks flow from such current sources.

Thus, IFj (j=0, 1, . . . , 3) is a current defined by:

$$IFj = \sum_{i=j\times n+1}^{(j+1)\times n} IFi \tag{1}$$

It is to be noted that the potential at both ends of the scanning wiring is Vs in FIG. 6A while it is assumed to be the ground potential GND. This is because the currents flowing from the modulation wirings to the selected scanning wiring are simulated, in the degeneration model, by the aforementioned current source, so that the amount of voltage drop on each portion of the scanning wiring can be determined by calculating the voltage (potential difference) of each portion, taking such Current supply portion as the reference potential.

Also the SCE's are omitted because the generated voltage drop itself, seen from the selected scanning wiring, remains same regardless of the presence or absence of the SCE as long as a same current is supplied from the column wirings. Therefore, the SCE's are omitted by representing the current flowing from the current sources of each block by the summed current of the device currents in each block (equation (1)).

Also the wiring resistance of the scanning wiring in each block is assumed as n times of the wiring resistance of the scanning wiring in a section, wherein a section means a portion of the scanning wiring between a crossing point with a column wiring and another crossing point with a neighboring column wiring. It is also assumed in the present example that the wiring resistance of the scanning wiring is constant among the sections.

In such degenerated model, the voltage drops DV0 to DV4 generated at the nodes on the scanning wiring can be calculated in simple manner by the following multiplication-summation equations:

$$DV0=a00\times IF0+a01\times IF1+a02\times IF2+a03\times IF3$$

$$DV1=a10\times IF0+a11\times IF1+a12\times IF2+a13\times IF3$$

$$DV2=a20\times IF0+a21\times IF1+a22\times IF2+a23\times IF3$$

$$DV3=a30\times IF0+a31\times IF1+a32\times IF2+a33\times IF3$$

$$DV4=a40\times IF0+a41\times IF1+a42\times IF2+a43\times IF3$$

or $$DVi = \sum_{j=0}^{3} aij \times IFj \tag{2}$$

wherein i=0, 1, 2, 3 or 4, and aij means a voltage generated at the i-th node when a unit current is injected into the j-th block only in the degeneration model (such definition being used hereinafter).

The aij mentioned above can be derived from the Kirchhoff's law and can be calculated once and stored as a table.

Furthermore, for the summed currents IF0 to IF3 defined by the equation (1) for the respective blocks, there is executed an approximation according to the following equation (4):

$$IFj = \sum_{i=j\times n+1}^{(j+1)\times n} IFi = IFS \times \sum_{i=j\times n+1}^{(j+1)\times n} Count\ i \tag{4}$$

wherein a variable Count i assumes a value 1 or 0 respectively when an i-th pixel on the selected scanning line is turned on or off.

Also IFS indicates the device current IF flowing when a voltage $V_{SEL}$ is applied across a SCE, multiplied by a coefficient α within a range of 0 to 1, namely:

$$IFS=\alpha\times IF \tag{5}$$

The equation (4) assumes that a device current flows from the column wirings of each block into the selected scanning wiring, in proportion to the number of turned-on devices in such block. In such assumption, the devices current IFS of a device, obtained by multiplying the device current IF of a device with a coefficient α, is adopted in consideration of the decrease in the device current resulting from an increase in the voltage of the scanning wiring by the voltage drop.

Figure 6C:
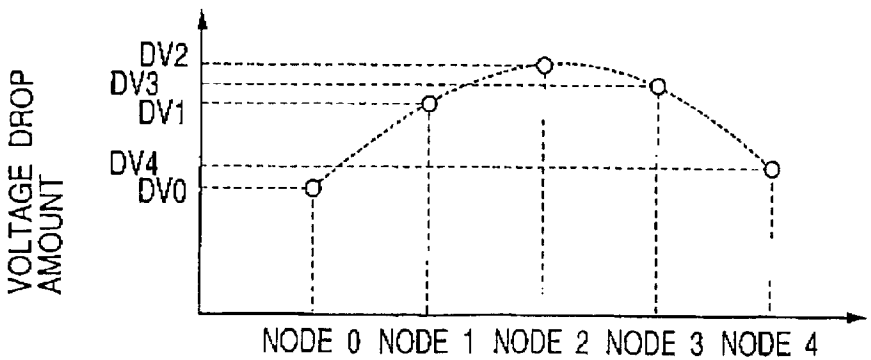

FIG. 6C shows an example of the calculation results of the voltage drops DV0 to DV4 at a certain turn-on state in the degeneration model.

Since the voltage drop shows a very smooth curve, the voltage drop between the nodes is estimated to approximately assume values represented by a broken line in FIG. 6C.

In this manner, the present degeneration model allows to calculate the voltage drop at each node and at a desired timing for any arbitrary image data.

In the foregoing, there has been calculated the voltage drops in a certain turn-on state, in a simplified manner by the degeneration model.

The voltage drop generated on the selected scanning wiring changes in time within a horizontal scanning period, and such change is estimated by determining the turn-on states at certain times (reference times) within a horizontal scanning period and calculating the voltage drops for such turn-on states utilizing the degeneration model.

The number of turn-on devices in each block at a certain timing within a horizontal scanning period can be determined in simple manner by referring to the image data of each block.

Now, as an example, it is assumed that the input data to the pulse width modulation circuit are of 8 bits and that the pulse width modulation circuit outputs a pulse width linearly proportional to the magnitude of the input data.

More specifically, the pulse width modulation circuit outputs a signal "L" for input data of 0, a signal "F" for the entire horizontal scanning period for input data of 255, and, for input data of 128, releases a signal H for a former half of the horizontal scanning period and a signal L for a latter half thereof.

In such case, the number of turn-on devices at the upshift timing (start time) of the pulse width modulation signal can be simply detected by counting the number of input data, larger than 0, into the pulse width modulation circuit.

Similarly, the number of turn-on devices at the center of a horizontal scanning period can be simply detected by counting the number of input data, larger than 128, into the pulse width modulation circuit.

In this manner, the number of turn-on devices at an arbitrary timing can be calculated in simple manner by comparing the image data with a threshold value and counting the true outputs of the comparator.

For simplifying the explanation hereafter, there is defined a time amount called time slot.

The time slot means the time front the start of the pulse width modulation signal with a horizontal scanning period, so that a time slot=0 indicates a time immediately after the start time (upshift in this case) of the pulse width modulation signal.

Also a time slot=64 is defined to indicate a time after the lapse of a period corresponding to 64 gradation levels from the start time of the pulse width modulation signal.

In the present example, the pulse width modulation is executed by modulating the pulse width from the start timing, but the present invention is likewise applicable to a case where the pulse width modulation is executed by modulating the pulse width based on the downshift timing of the pulse, though the direction of proceeding of the time axis and the time slot is inversed.

(Calculation of Adjustment Data from Voltage Drop)

As explained in the foregoing, the change in time of the voltage drops within a horizontal scanning period can be calculated in approximate and discrete manner by repeating the calculation with the degeneration model.

Figure 7:
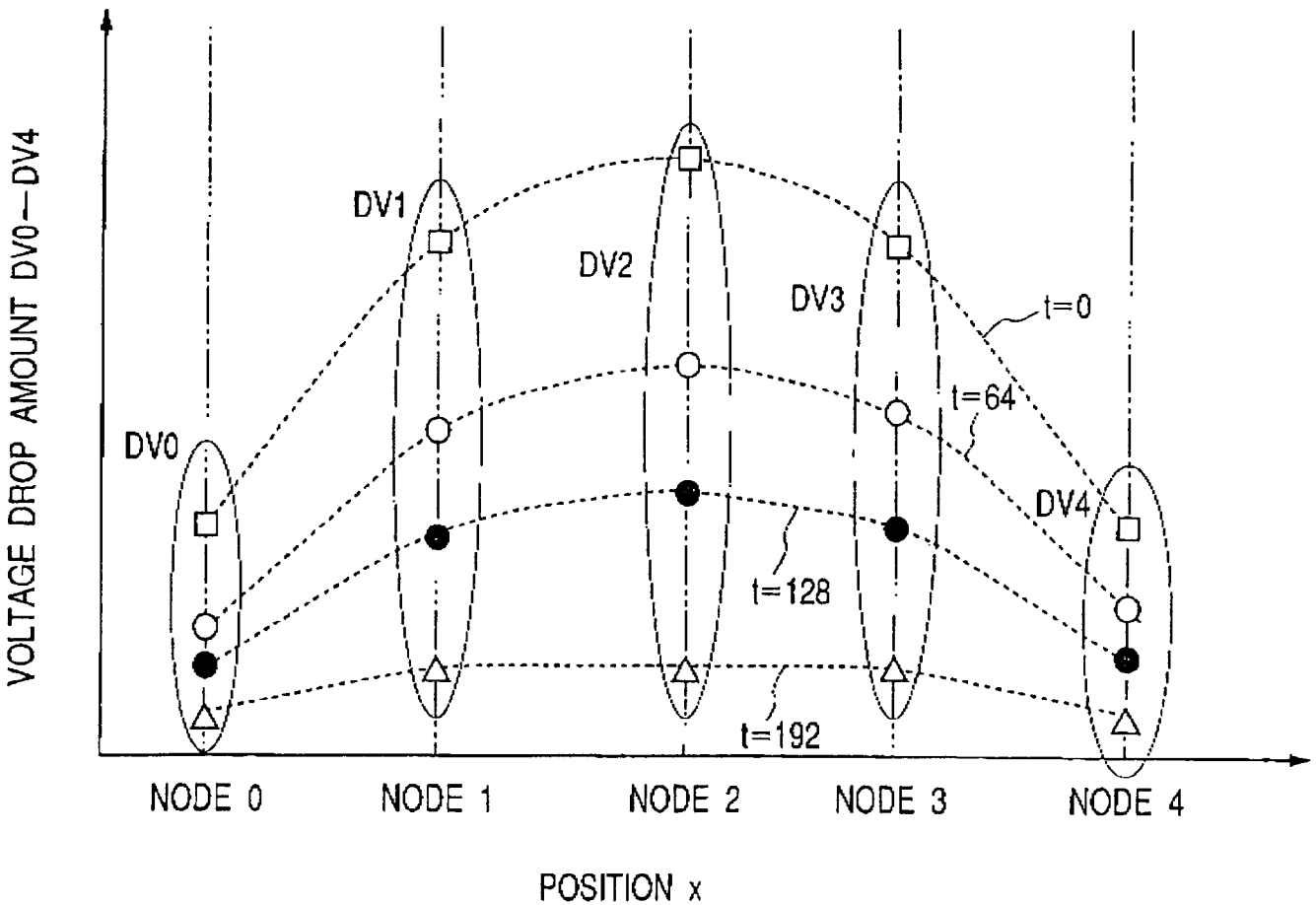
FIG. 7 is a chart showing voltage drop amounts calculated in discrete manner.

FIG. 7 shows an example of calculation of the change in time of the voltage drops in the scanning wiring by repeating the calculation of voltage drops for certain image data. (The illustrated voltage drops and changes thereof in time only constitute an example for certain image data, and the voltage drops for other image data naturally assume different behavior.)

In FIG. 7, the voltage drops are calculated in discrete manner for four timings of time slot=0, 64, 128 and 192, by applying the degeneration model for each timings.

In FIG. 7, the voltage drops at the different nodes are connected by a broken line, but such broken line is shown only for the purpose of clarity, and the voltage drops are calculated by the present degeneration model in discrete manner at the node positions represented by □, ○ and Δ.

As the magnitude of the voltage drop and the change thereof in time are rendered calculable as explained in the foregoing, the present inventors have investigated, as a next step, a method of calculating adjustment data for correcting the image data for the voltage drop.

Figure 8:
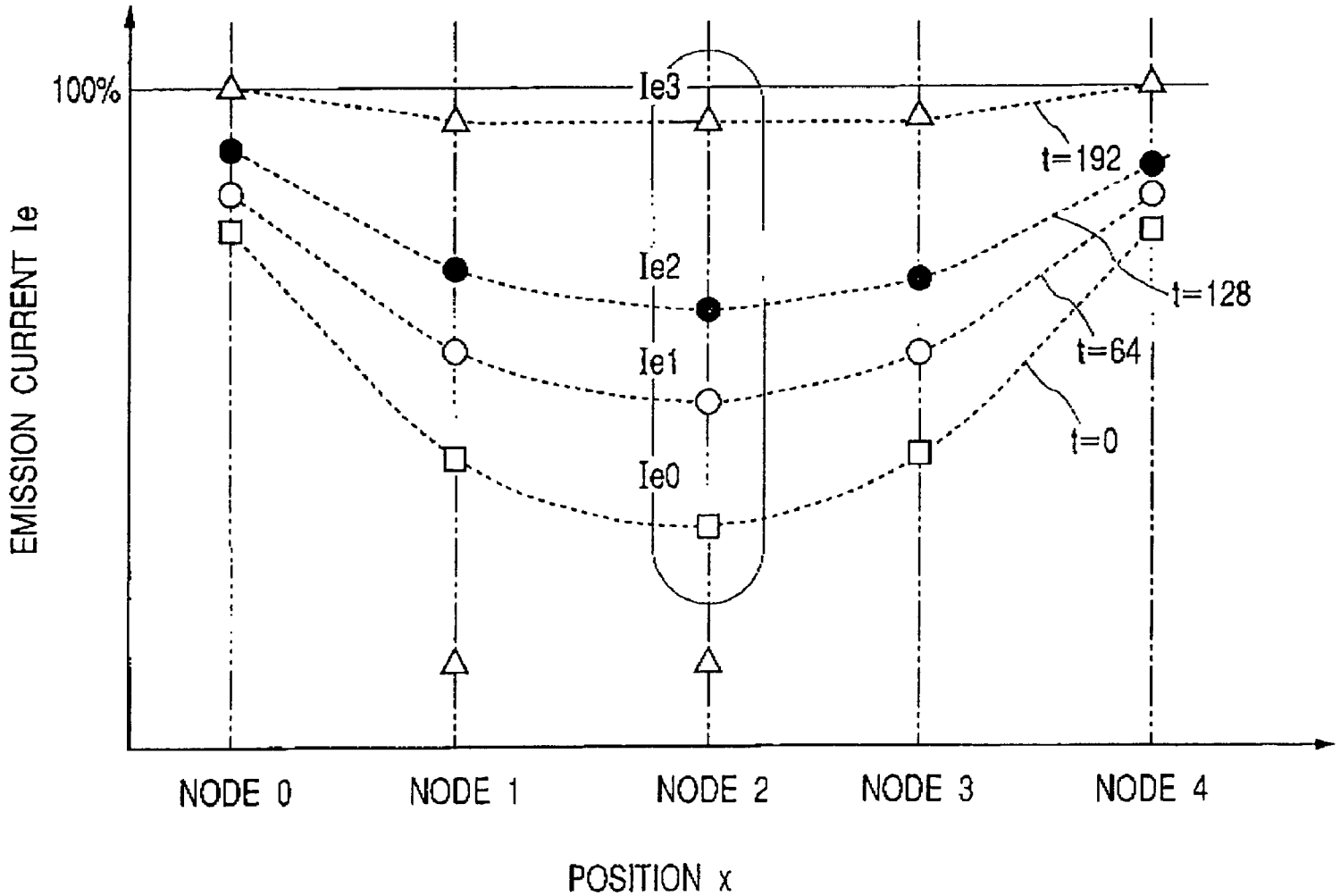
FIG. 8 is a chart showing changes in the emission current calculated in discrete manner.

FIG. 8 is a chart showing estimated emission currents of the SCR in the turn-on state, in case the voltage drops shown in FIG. 7 are generated on the selected scanning wiring.

The ordinate indicates the omission current in percentage at each time and at each position, taking the emission current in the absence of the voltage drop as 100%, and the abscissa indicates the horizontal position.

As shown in FIG. 8, at the horizontal position of node 2 (reference point), there are defined:

emission Ie0 at time slot=0;

emission Ie1 at time slot=64;

emission Ie2 at time slot=128; and emission Ie3 at time slot=192.

The values in FIG. 8 are calculated from the voltage drops in FIG. 7 and the drive voltage-emission current chart shown in FIG. 4. More specifically, FIG. 8 shows the plotting of an emission current under the application of a voltage obtained by subtracting the voltage drop from the voltage $V_{SEL}$.

Consequently FIG. 8 merely shows the current released from the SCE in the turn-on state, and no current is released from the SCE in the turn-off state.

In the following there will be explained a method of calculating, from the amount of voltage drop, the adjustment data for correcting the image data.

Figure 9A:
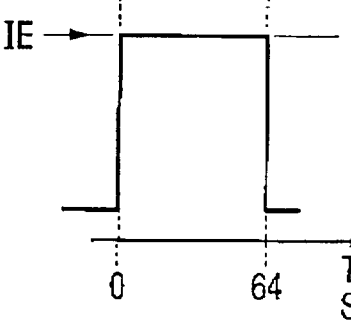
FIGS. 9A, 9B and 9C are views showing a method for calculating adjustment data in an embodiment of the present invention.
Figure 9B:
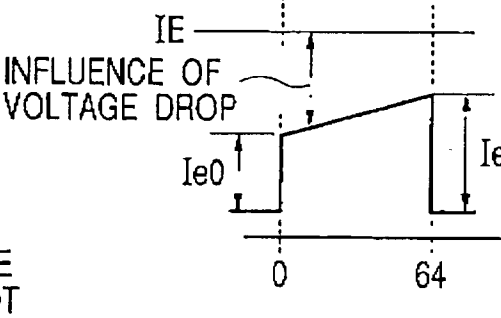
Figure 9C:
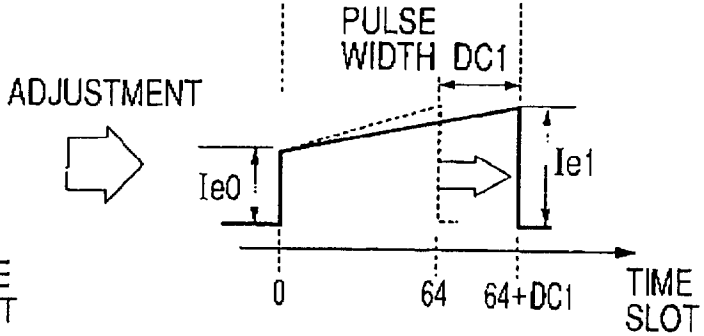

FIGS. 9A, 9B and 9C are views showing the method for calculating the adjustment data for compensating the voltage drop, based on the change in time of the emission current shown in FIG. 8. These figures show an example of calculation of the adjustment data for image data with a magnitude 64.

The luminance of light emission corresponds to the amount of emitted charge, obtained by integrating in time the emission currently resulting from the emission current pulse. In the following description, therefore, the emitted charge amount is used in considering the variation in the luminance by the voltage drop.

Taking the emission current in the absence of influence of the voltage drop as IE and a time corresponding to a gradational level in the pulse width modulation as Δt, the emitted charge amount Q0 to be emitted by the emission current pulse corresponding image data of 64 is obtained by multiplying the amplitude IE of the emission current pulse with the pulse width (64×Δt), namely:

$$Q0=IE\times 64\times \Delta t \tag{6}$$

In practice, however, there is generated a decrease in the emission current by the voltage drop on the scanning wiring.

The emission charge amount by the emission current pulse in consideration of the influence of the voltage drop can be calculated in approximate manner as explained in the following.

Taking the emission currents at time slots=0, 64 at the node 2 respectively as Ie0 and Ie1 and adopting an approximation that the emission current in the range of 0 to 64 linearly changes between Ie0 and Ie1, the emission charge amount Q1 in such range can be represented by a trapezoidal area shown in FIG. 9B, namely calculated by:

$$Q1=(Ie0+Ie1)\times 64\Delta\times t\times 0.5 \tag{7}$$

Then, as shown in FIG. 9C, it is assumed that the influence of the voltage drop can be eliminated by extending the pulse width by DC1, in odder to compensate the loss of the emission current resulting from the voltage drop.

Also in case of extending the pulse width for the adjustment of the voltage drop, the emission current amount is considered to vary in each time slot, but, for the purpose of simplicity, the emission current is assumed to become Ie0 at the time slot=0 and Ie1 at a time slot=(64+DC1) as shown in FIG. 9C.

Also the emission current between the time slot=0 and the time slot=(64+DC1) is approximated to assume a value on a straight line connecting the emission currents at the two points Therefore, the emission charge amount Q2 by the emission current pulse after adjustment is given by:

$$Q2=(Ie0+Ie1)\times(64+DC1)\times\Delta t\times 0.5 \quad (8).$$

Assuming that this is equal to Q0 mentioned before, there is obtained:

$$IE\times 64\times\Delta t=(Ie0+Ie1)\times(64+DC1)\times\Delta t\times 0.5$$

By rearranging this equation with respect to DC1, there is obtained:

$$DC1=\{(2\times IE-Ie0-Ie1)/(Ie0+Ie1)\}\times 64 \quad (9).$$

The adjustment data for the image data of 64 are calculated in the above-described manner.

Thus, for the image data of a magnitude of 64 at the position of node 2, there should be added an adjustment amount of CData=DC1 as shown in the equation (9).

Figure 10A:
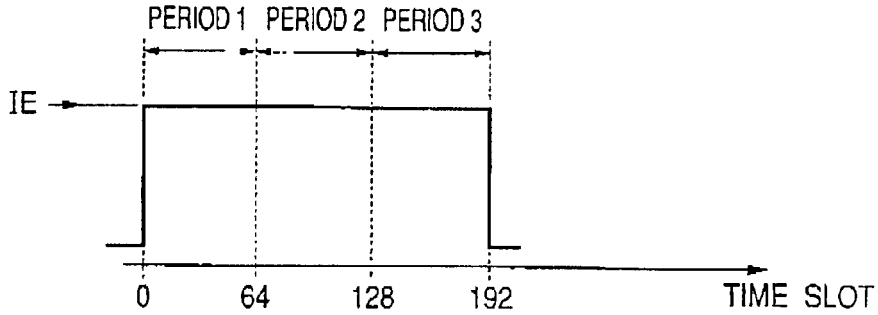
FIGS. 10A, 10B and 10C are charts slowing an example of calculation of the adjustment data in case image data have a magnitude of 192.
Figure 10B:
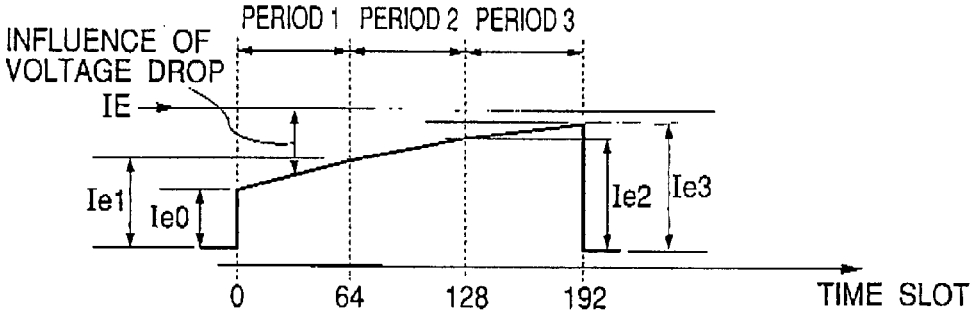
Figure 10C:
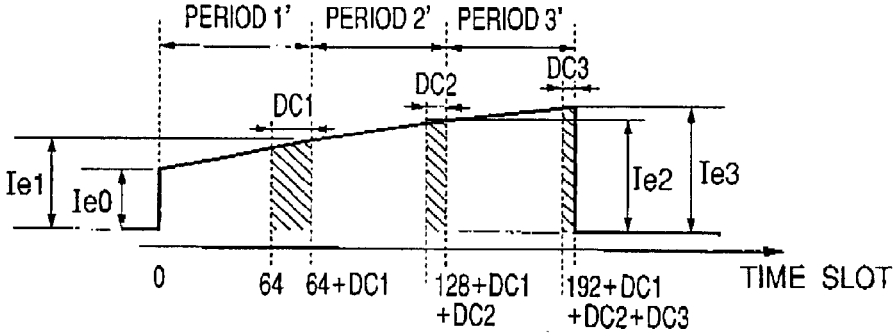

Also for image data of a magnitude of 192, there can be determined the adjustment amounts for each of three periods as shown in FIGS. 10A and 10B.

Also for a pulse width 0, there is naturally no influence of the voltage droop on the emission current, the adjustment data are selected as 0 and the adjustment data CData to be added to the image data are also selected as 0.

Such calculation of the adjustment data for the discrete image data such as 0, 64, 1128 and 192 intends to reduce the amount of calculation.

Figure 11A:
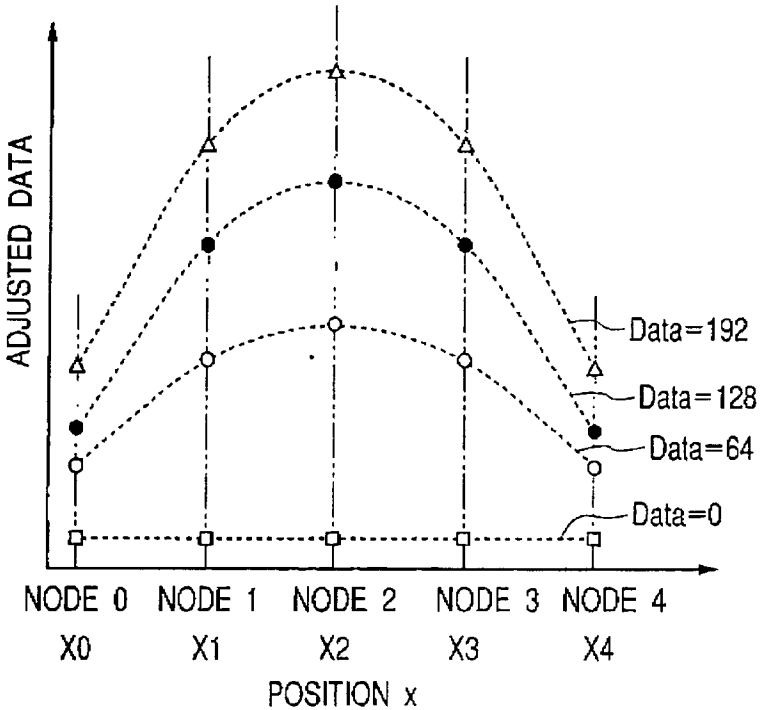
FIGS. 11A and 11B are views slowing a method of interpolation of the adjustment data in an embodiment of the present invention.

FIG. 11A shows an example of the discrete adjustment data for certain input image data, obtained by the above-described method, wherein the abscissa corresponds to the horizontal display positions including the node positions, while the ordinates represents the magnitude of the adjustment data.

The discrete adjustment data are calculated for the node positions indicated by □, ○, ● and Δ and the different magnitudes of the image data Data (image data reference values of 0, 64, 128 and 192).

(Interpolating method for discrete adjustment data)

The adjustment data are calculated in discrete manner corresponding to the node positions, and do not provide the adjustment data for an arbitrary horizontal position (arbitrary column wiring number). Also such adjustment data correspond to the image data of certain predetermined magnitudes of the reference values of the image data at the respective node positions and do not provide tie adjustment data corresponding to the magnitudes of the actual image data.

In the following, therefore, there will be explained a method of linear interpolation of the discretely calculated adjustment data thereby obtaining the adjustment data for arbitrary image data on each column wirings.

Figure 11B:
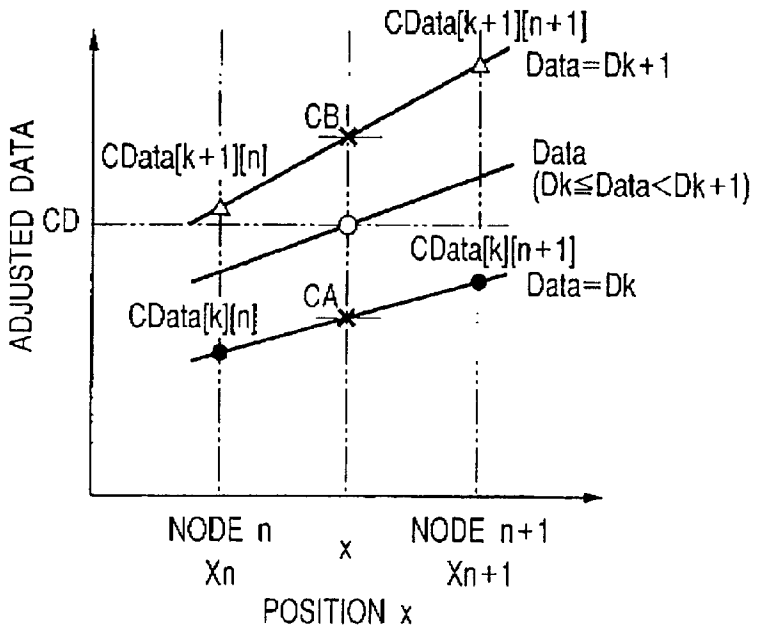

FIG. 11B inustrates a method of calculating the adjustment data corresponding to the image data Data, in a position x between a node n and another node n+1.

It is assumed that the adjustmnent data are already calculated in discrete manner for positions Xn, Xn+1 corresponding to the nodes n, n+1.

It is also assumed that the input image data Data assume a value between the two reference values Dk, Dk+1 of the image data for which the adjustment data are calculated in discrete manner.

By representing the adjustment data for the reference value Dk of k-th image data at a node n by CData[k] [n], the adjustment data CA for the image data Dk at a position x can be calculated as follows, utilizing linear interpolation based on the values CData[k] [n] and CData[k] [n+1]:

$$CA=\frac{(X_{n+1}-x)\times CData[k][n]+(x-X_n)\times CData[k][n+1]}{X_{n+1}-X_n} \quad (17)$$

Also the adjustment data CB for the image data $D_{k+1}$ at a position x can be calculated in the following manner:

$$CB=\frac{(X_{n+1}-x)\times CData[k+1][n]+(x-X_n)\times CData[k+1][n+1]}{X_{n+1}-X_n} \quad (18)$$

Adjustment data CD for the image data Data at the position x can be calculated in the following manner by linear approximation of the adjustment data CA and CB:

$$CD=\frac{CA\times(D_{k+1}-Data)+CB\times(Data-D_k)}{D_{k+1}-D_k} \quad (19)$$

As explained in the foregoing, the adjustment data matching the actual position and the actual magnitude of the image data can be calculated from the discrete adjustment data in simple manner by the method according to the equations (17) to (19). In FIG. 11A, the dot lines connecting between nodes are the interpolation results performed on the discrete adjusted data according to the above calculations. As shown by one drawing, in the voltage drop adjustment method according to the present invention, since no voltage drop takes place when an image data is zero, the same adjusted data is figured out for position x (not to mention, including in adjusted data of zero). However, for the sane image data which is not zero, the adjusted data having a gentle slope-distribution is figured out for one position x, that is one horizontal direction in the display. While, where the direction via scan line is a vertical direction in the display, the adjusted data having a gentle slope-distribution is figured out for the vertical direction in the display.

By correcting the image data by adding thus calculated adjustment data to the image data and executing pulse width modulation according to the image data after correction, it is rendered possible to reduce the deterioration of image quality resulting from the voltage drop, encountered in the conventional technology, thereby improving the image quality.

(Function of Entire System and Principal Parts)

Figure 1:
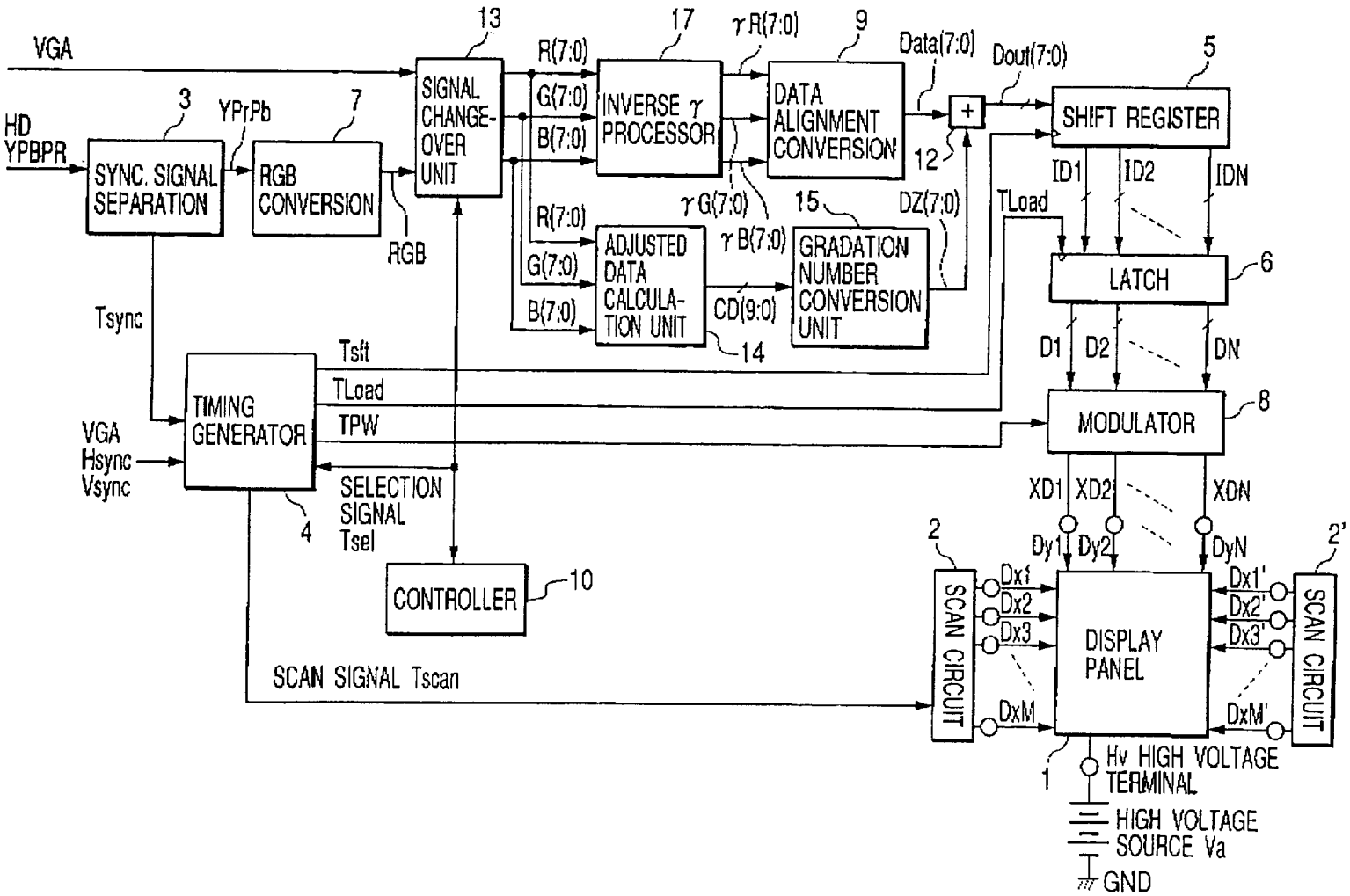
FIG. 1 is a schematic block diagram showing the circuit configuration of an image display apparatus constituting a first embodiment of the present invention.

FIG. 1 is a schematic block diagram showing the circuit configuration of the image display apparatus of the present invention.

In FIG. 1, there are shown a display panel 1, terminals Dx1 to DxM, Dx1' to DxM' of the scanning wirings of the display panel, terminals Dy1 to DyN of the modulation wirings of the display panel, a high voltage terminal Hv for applying an accelerating voltage between the face plate and the rear plate, and a high voltage source Va. There are also shown a scanning circuit 2, a synchronization signal separating circuit 3, a timing generating circuit 4, a conversion circuit 7 for converting YPrPb signals from the synchronization signal separating circuit 3 into RGB signals, a shift register 5 of a line of image data, a latch circuit 6 of a line of image data, a pulse width modulation unit 8 for outputting modulation signals to the modulation wirings of the display panel, an adder 12 for adding image data and adjustment data to output adjusted image data Dout, an adjustment data calculation unit 14, and a gray scale number conversion unit 15.

Also in FIG. 1, there are shown RGB input image data R[7:0], G[7:0] and B[7:0] of an 8-bit width, image data gR[7:0], gG[7:0] and gB[7:0] of ail 8-bit width subjected to inverse γ-conversion, and serial image data Data[7:0] of an 8-bit width subjected to parallel-serial conversion by a data arrangement conversion unit.

There are also shown adjustment data CD[9:0] of a 10-bit width, adjustment data DZ[7:0] of an 8-bit width subjected to conversion of gray scale number, and image data Dout [7:0] of an 8-bit width after addition of the adjustment data.

(Adder 12)

The adder 12 serves to add the adjustment data CD from the adjustment data calculation unit and tile image data Data. By the addition, the image data Data are corrected, and outputted as the image data Dout to the shift register.

In the addition of the image data Data and the adjustment data CD, there may result an overflow in the adder. Therefore, in order to avoid such overflow in the present embodiment, the bit width of the adder and that of the succeeding modulation unit are determined in consideration of the maximum value in the addition of the image data Data and the adjustment data CD.

More specifically, in the image display apparatus of the present embodiment, the adjustment data become 120 at maximum for an image where the image data are all 255 to provide a maximum output of the adder of 255+120=375, whereby the number of output bits of the adder and the number of bits of the modulation unit are selected as 9 bits and the number of bits of various units are determined accordingly.

Also for avoiding overflow, there may also be adopted a configuration of estimating in advance the maximum value of the adjustment data to be added and reducing in advance the variable range of the image data so as not to cause overflow in case such maximum value is added.

The variable range of the image data can be reduced for example by limiting the input image data at the A/D conversion thereof or by providing a multiplier for multiplying the image data with a gain within a range of 0 to 1 thereby limiting the magnitude of the image data.

Also it is possible to provide a limiter in the adjustment data output unit.

(Delay Circuits 19)

Image data SData rearranged by the data arrangement conversion unit are entered in the adjustment data calculation unit and a delay circuit (delay means) 19. An adjustment data interpolation unit at the adjustment data calculation unit refers to the horizontal position information x from the timing control circuit and the image data SData thereby calculating the matching adjustment data CD.

The delay circuit 19 is provided for absorbing the time required for calculating the adjustment data, and executes delaying, at the addition of the adjustment data to the image data in the adder, in such a manner that the image data are properly added with the matching adjustment data. such delay circuit can be composed of a flip-flop.

(Details of Modulation Unit)

Parallel image data D1 to DN outputted from the latch circuit 6 are supplied to the modulation unit 8.

Figure 12A:
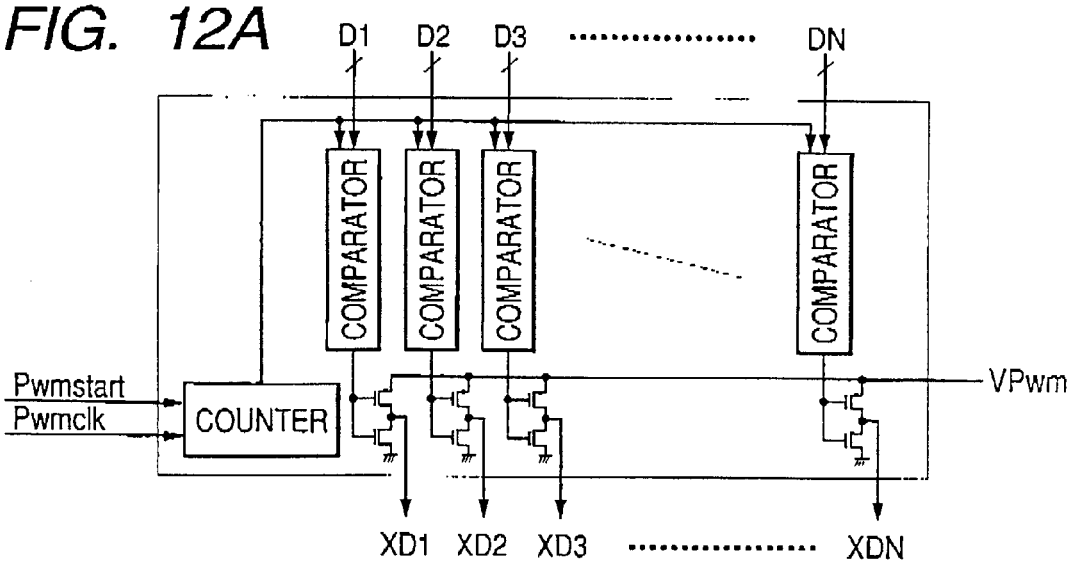
FIGS. 12A, 12B and 12C are views showing configuration and function of modulation means in the image display apparatus embodying the present invention.

The modulation unit consists of a pulse width modulation circuit (PWM circuit) composed, as shown in FIG. 12A, of a PWM counter and a comparator and a switch (FET in FIG. 12A) for each modulation wiring.

Figure 12B:
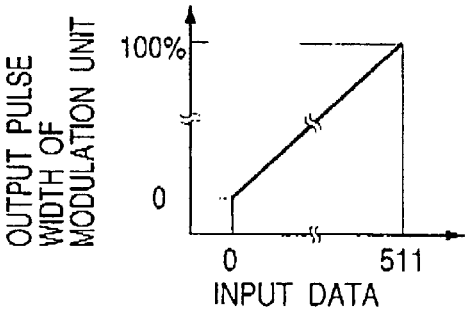

The image data D1 to DN are linearly correlated with the output pulse width of the modulation unit, as shown in FIG. 12B.

Figure 12C:
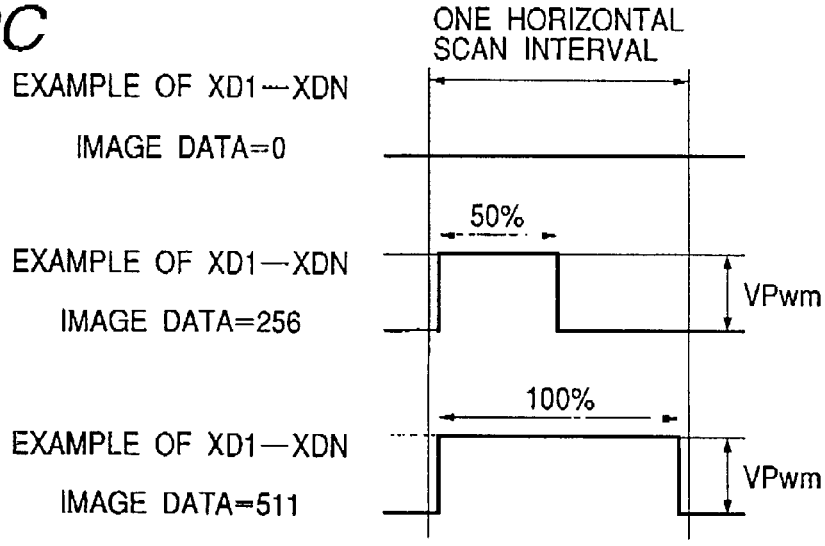

FIG. 12C shows three examples of the output wave form of the modulation unit.

The upper, middle and lower wave forms in FIG. 12C respectively correspond to input data 0, 256 and 511 to the modulation unit.

In the present embodiment, the number of bits of the input data D1 to DN to the modulation unit are selected as 9 bits in order to avoid overflowing as explained in the foregoing.

In the foregoing description, there was described that the modulation signal of a pulse width corresponding to a horizontal scanning period was outputted in response to the input data 511 to the modulation unit, but, in more details, non-driving periods, though very short, are provided before the upshift of the pulse and after the downshift of the pulse as margins in timing.

(Adjustment Data Calculation Unit)

Figure 13:
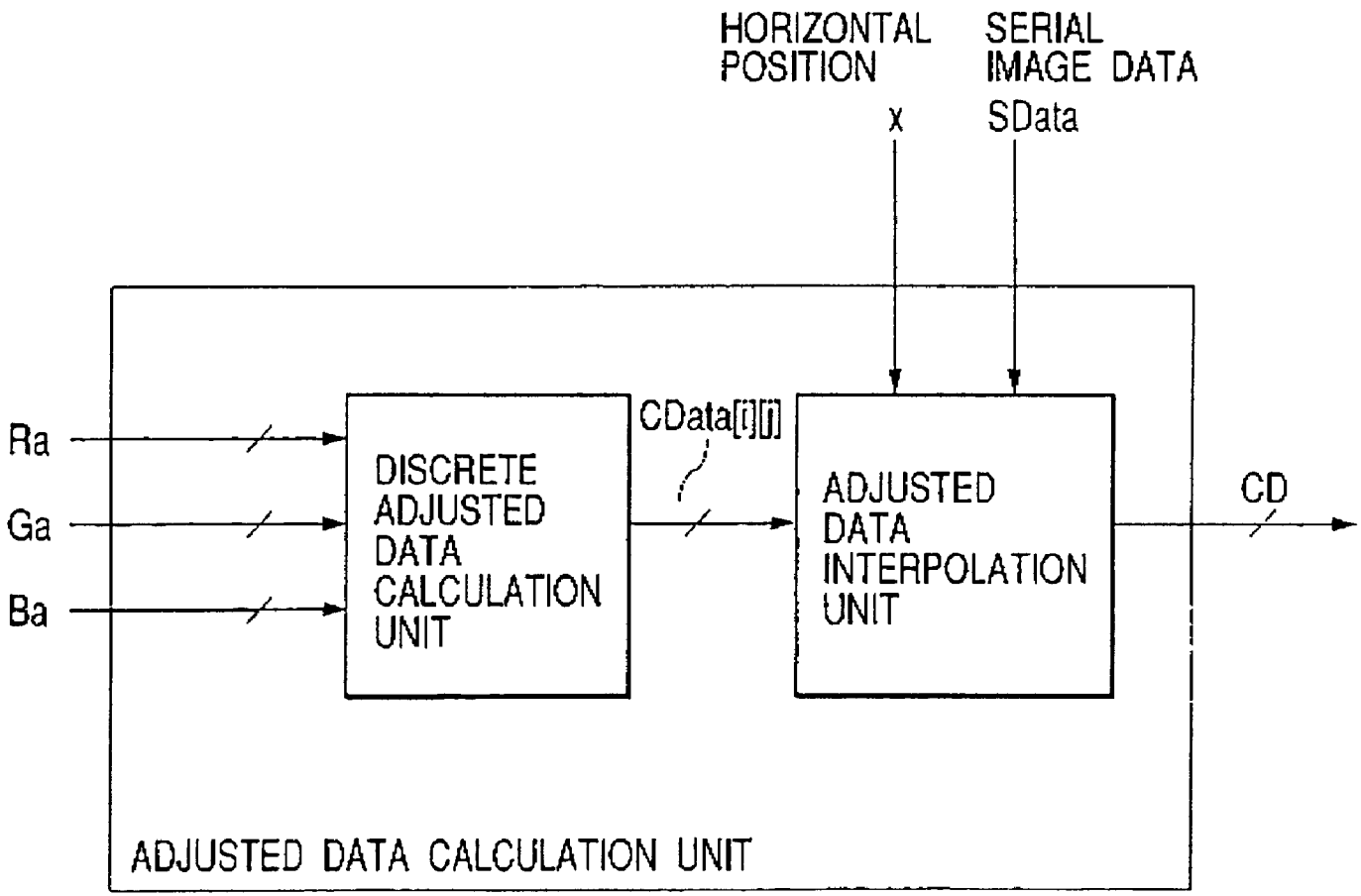
FIG. 13 is a block diagram showing the configuration of adjustment data calculation means of the image display apparatus embodying the present invention.

The adjustment data calculation unit serves to calculate the adjustment data for the voltage drop, by the aforementioned adjustment data calculating method, and is composed, as shown in FIG. 13, of two block, namely a discrete adjustment data calculation unit and all adjustment data interpolation unit.

The discrete adjustment data calculation unit calculates the voltage drops from the input image signal and also calculates the adjustment data from the voltage drops in discrete manner. In order to reduce the amount of calculation and of hardware, such unit calculates the adjustment data in discrete manner by introducing the concept of the aforementioned degenerated model.

The adjustment data calculated in discrete manner are interpolated by the adjustmnent data interpolation unit (adjustment data interpolating means) to provide the adjustment data CD matching the magnitude of the image data and the horizontal. display position x thereof.

(Discrete Adjustment Data Calculation Unit)

The discrete adjustment data calculation unit executes division of the image data into blocks and calculation of the statistical amount (number of turn-on devices) for each block, and performs a function as a voltage drop calculating unit for calculating the change in time of the voltage drop at each node position from the aforementioned statistical amount, a function of converting the voltage drop at each time into the luminance of emitted light, a function of integrating the luminance of emitted light in time thereby obtaining the total luminance of emitted light, and a function of calculating therefrom the adjustment data for the reference value of the image data at the discrete reference points.

(Adjustment Data Interpolation Unit)

The adjustment data interpolation until serves to calculate the adjustment data matching the display position (horizontal position) of the image data and the magnitude thereof. Such unit executes interpolation on the discretely calculated adjustment data, thereby providing the adjustment data matching the display position (horizontal position) of the image data and the magnitude thereof.

(Operation Timing of Various Units)

Figure 15:
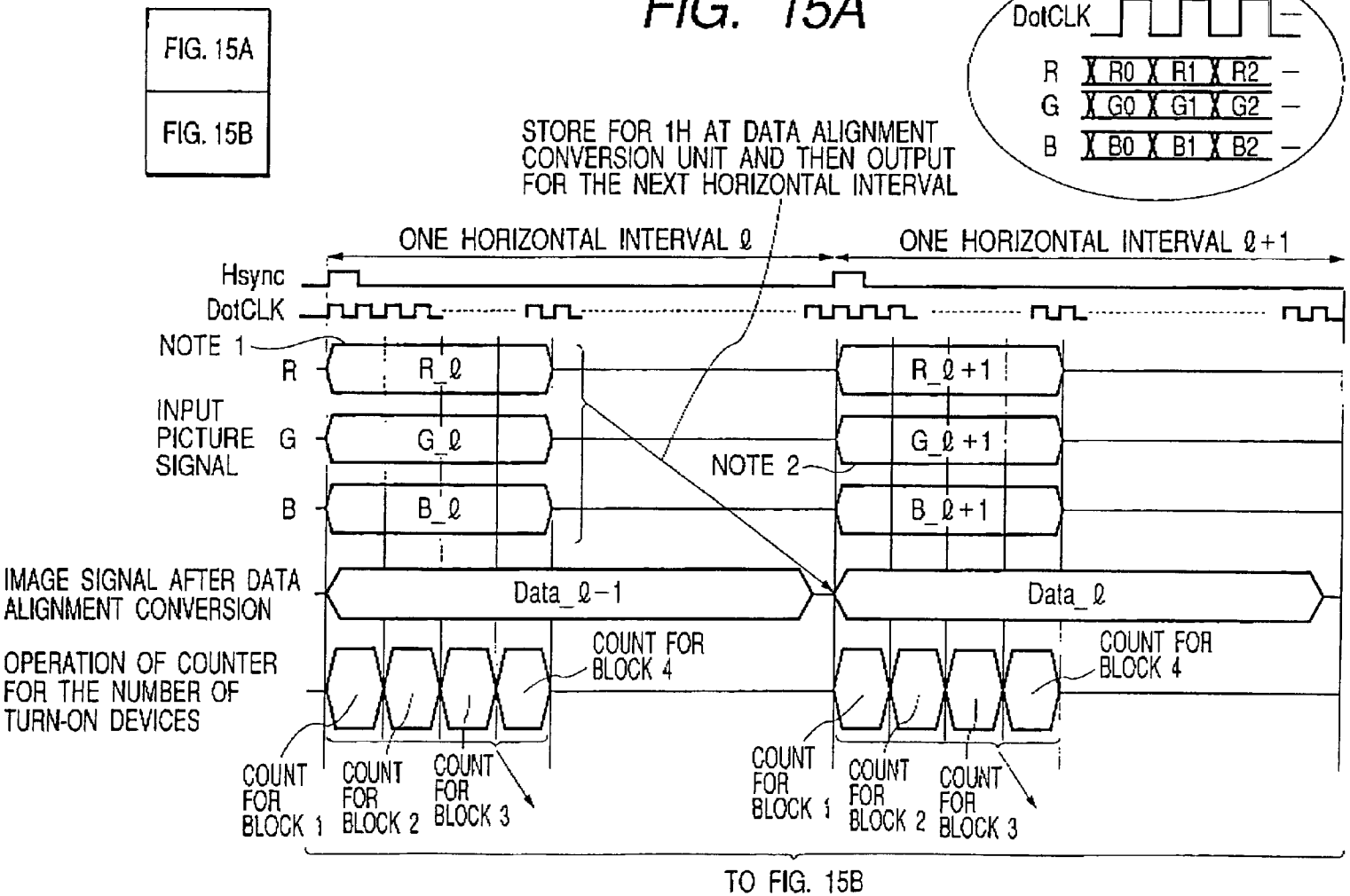
FIG. 15 is comprised of FIGS. 15A and 15B showing timing charts of, the image display apparatus embodying the present invention.
Figure 15B:
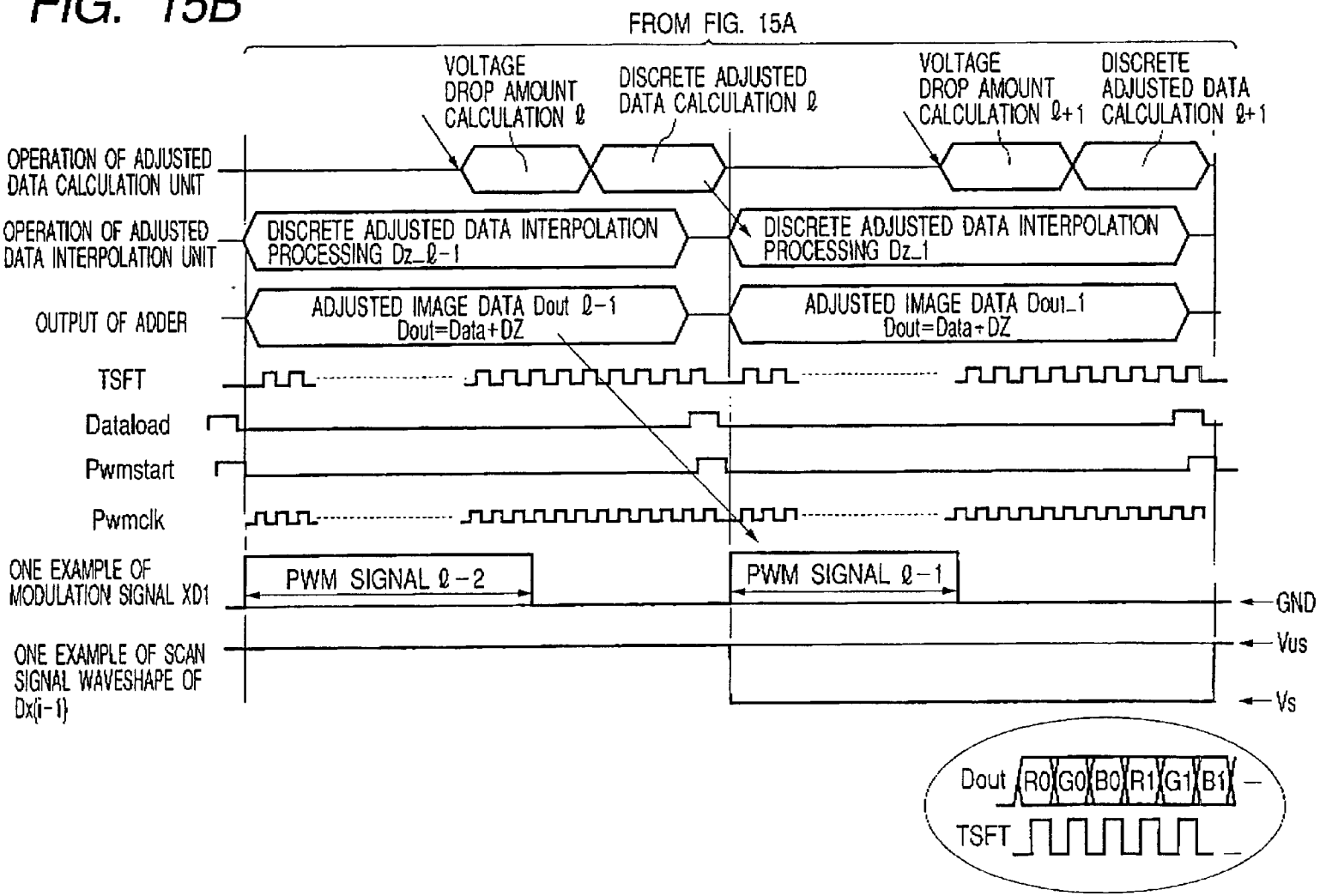

FIGS. 15A and 15B are timing charts showing the operation timings of various units.

In FIGS. 15A and 15B, there are shown a horizontal synchronization signal Hsync, a clock signal DotCLK prepared from the horizontal synchronization signal Hsync by a PLL circuit in the timing generation circuit, digital image data R, G, B from an input switching circuit, image data Data after conversion of data arrangement, image data Dout after adjustment for the voltage drop, a shift clock signal TSFT for transferring the image data Dout to the shift register 5, a load pulse Dataload for latching the data in the latch circuit 6, a start signal Pwmstart for the aforementioned pulse width modulation, and a modulation signal XD1 constituting an example of the pulse width modulation signal supplied to the modulation wirings 1.

Simultaneous with the start of a horizontal scanning period, the digital image data RGB are transferred from the input switching circuit.

Referring to FIGS. 15A and 15B, the image data R_I, G_I, B_I entered in the horizontal scanning period I are accumulated in the data arrangement conversion circuit 9 for at horizontal scanning period, and are outputted as digital image data Data_I according to the pixel arrangement of the display panel in a horizontal scanning period I+1.

The image data R_I, G_I, B_I are entered in the horizontal scanning period I into the adjustment data calculation unit, which counts the number of turn on devices as explained in the foregoing and calculates the voltage drop amount at the end of the counting.

In succession to the calculation of the voltage drop amount, there are calculated the discrete adjustment data, and the results of calculation are stored in the register.

Then, in a succeeding scanning period I+1, in synchronization with the output of the image data Data_I of the immediately preceding horizontal scanning period, the adjustment data interpolation unit executes interpolation of the discrete adjustment data, thereby providing the adjustment data. The interpolated adjustment data are immediately subjected to the conversion of number of gradation levels in the gray scale number conversion unit 15 and are supplied to the adder 12.

The adder 12 adds the image data Data and the adjustment data CDx in succession and transfers the adjusted image data Doout to the shift register. The shift register stores the image data Dout of a horizontal scanning period according to the signal TSFT and also executes serial-parallel conversion to output parallel image data ID1 to IDN to the latch circuit 6. The latch circuit 6 latches the parallel image data ID1 to IDN from the shift register in synchronization with the upshift of the signal Dataload, and transfers the latched image data D1 to DN to the pulse width modulation unit 8.

The pulse width modulation unit 8 outputs the pulse width modulation signal of a pulse width corresponding to the latched image data. Therefore, in the image display apparatus of the present embodiment, the pulse width modulation signal outputted by the modulation unit is displayed with a delay of two horizontal scanning periods from the input of the image data.

such image display apparatus is enabled, in the image displaying operation, to compensate the voltage drop in the scanning wiring encountered in the conventional technology and to reduce thus resulting deterioration of the displayed image, thereby providing very satisfactory image display.

Also there can be obtained excellent effects of very easily calculating the adjustment data by calculating the adjustment data in discrete manner and interpolating such adjustment data in positions between the discretely calculated points and also by a very simple hardware.

In an image portion where the magnitude of the image data is small, the influence of an error in the calculation of the adjustment data tends to become conspicuous. On the other hand, in an image portion where the magnitude of the image data is large, the influence of the error in the calculation of the adjustment data is loss conspicuous because the magnitude of the image data themselves is large.

In consideration of these features, it is preferable, in order to reduce the error in adjustment, to select a smaller interval for the reference values of the image data in the image portion where the magnitude of the image data is small, and to select a larger interval for the reference values of the image data in the image portion where the magnitude of the image data is large.

(Second Embodiment)

In the foregoing first embodiment, reference values of the image data are selected in discrete manner for the input image data, then reference points are selected on the row wirings, and the adjustment data are calculated for the image data of the magnitudes of the reference values at such reference points.

Then the adjustment data calculated in discrete manner are interpolated to obtain the adjustment data corresponding to the horizontal display position of the input image data and the magnitude thereof, and such adjustment data are added to the image data to achieve adjustment.

On the other hand, similar adjustment can also be achieved by the following configuration.

More specifically, it is possible to calculate the adjustment result of the image data corresponding to the discrete horizontal positions and the reference values of the image data (namely the sum of the aforementioned discrete adjustment data and the reference values of the image data, or the adjusted image data), and to interpolate the discretely calculated adjustment results thereby obtaining the adjustment result corresponding to the horizontal display position of the input image data and the magnitude thereof, and to execute modulation according to such adjustment result.

In such configuration, it is not necessary to add the image data and the adjustment data after the interpolation, since the discrete calculation provides the summed result of the image data and the adjustment data. In FIG. 11A, the adjusted image data calculated in the above manner also has the same type of distribution as in FIG. 11A. That is, since no voltage drop takes place when an image data is zero, the sane adjusted data is figured out for position x. However, for the same image data which is not zero, the adjusted data having a gentle slope-distribution is figured out for one position x, that is one horizontal direction in the display. While, where the direction via scan line is a vertical direction in the display, the adjusted data having a gentle slope-distribution is figured out for the vertical direction in the display.

(Gray Scale Number Converting Unit)

In the following there will be given an explanation on the gray scale number converting unit which constitutes an important part in the present invention.

As explained in the foregoing, the adjustment data for the voltage drop are calculated with a precision of 10 bits while the image data are given in 8 bits. More specifically, the uppermost bit (MSB) of the image data corresponds to the MSB of the adjustment data, and the adjustment data are calculated with a higher precision by two bits below the fractional point.

In the present embodiment, since the number of gradation levels of the modulation unit is 8 bits, the adjustment data of 10 bits have to be converted into those of 8 bits.

Therefore, in the present embodiment, in order to represent gradation of 10 bits in pseudo manner with the adjustment data of 8 bits, the dither method is employed for converting the 10-bit data into 8-bit data.

Figures 14A, 14B:
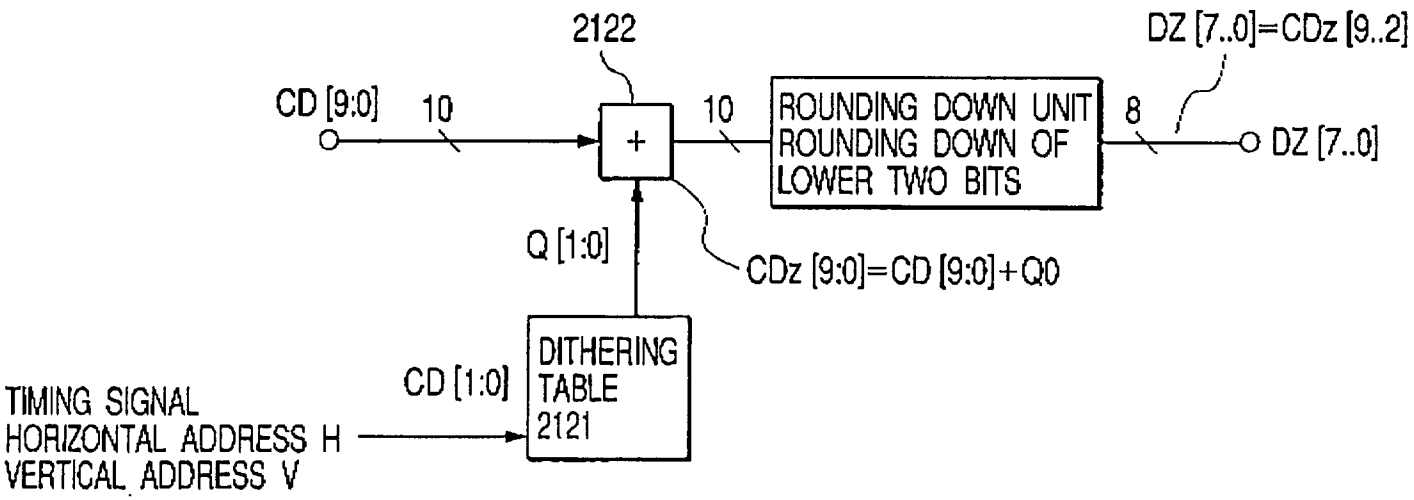
FIGS. 14A and 14B are views showing dither method.

More specifically, as shown in FIG. 14A, the gray scale number converting unit of the present embodiment is means for converting the 10-bit adjustment data CD[9:0] into 8-bit adjustment data DZ[7:0] by the dither method.

In FIG. 14A, there are shown a dither table 2121 and an adder 2122.

The dither table 2121 outputs dither data Q0 according to the horizontal address position and the vertical address position of the adjustment data.

The horizontal and vertical address positions of the adjustment data mean those of the image data which are adjusted by such adjustment data.

More specifically, states where the horizontal address position of the adjustment data is odd or even are respectively defined as H='1' and H='0', while states where the vertical address position of the adjustment data is odd or even are respectively defined by V='1' and V='0', and dither data Q0 defined as shown in FIG. 14B are outputted according to the states of H and V.

The output Q0 of the dither table is added by the adder 2122 to the adjustment data CD[9:0], and the lower 2 bits of the adjustment data CDz[9:0] after addition are discarded by rounding means to obtain 8-bit adjustment data DC[7:0] (namely CDz[9:2]).

such gray scale number converting unit allows not only to execute conversion of the number of gradation levels of the adjustment data of 10 bits into those of 8 bits but also to represent the number of gradation levels corresponding to 10 bits with the image data of 8 bits in pseudo manner by area modulation over the entire image, thereby achieving very satisfactory adjustment.

The present inventors have also confirmed that the dither method for reflecting the lower 2 bits of the adjustment data into the upper 8 bits is not limited to the aforementioned dither method applied in spatial directions but can also be achieved by a dither method involving development in the direction of time.

In order to achieve the dither method applied in the direction time, instead of varying the dither data according to the horizontal and vertical address positions as shown in FIG. 14A, it is possible to very the dither data Q0 depending on the horizontal address position and the frame (odd frame or even frame) or depending on the vertical address position and the frame or a combination thereof.

The dither method can also be, instead of the aforementioned method utilizing a dither table, a random dither method in which a train of random numbers is added to the adjustment data and quantization is then executed. There may also be employed a systematic dither method of adding a dither matrix (dither table) such as a Bayer matrix as shown in FIGS. 14A and 14B to the adjustment data and then discarding the lower bits.

Also the dither method is not restrictive, and there may be adopted another method capable of converting the number of gradation levels and representing the intermediate gradations, such as error diffusion method.

The aforementioned adjustment by reducing the minimum resolution of the adjustment data by the dither method provides an excellent effect of rendering less conspicuous the hindrance effect to be generated by the adjustment as will be explained in the following.

(Advantage of Precise Calculation of Adjustment Data)

FIGS. 16A to 16E show hindrance patterns confirmed in the calculation of the adjustment data calculated with a number of bits same as that of the image data.

Figure 16A:
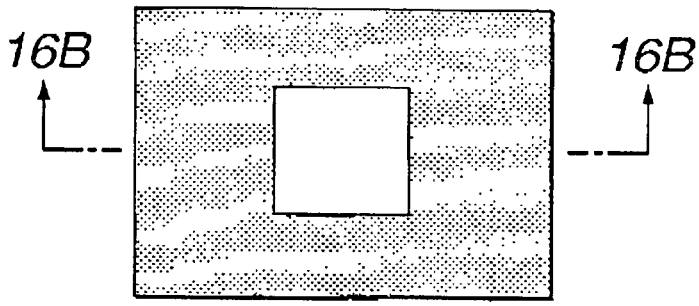
FIGS. 16A, 16B, 16C, 16D and 16E are views showing hindrance patterns.

FIG. 16A shows an image to be displayed, corresponding to input image data having a white window at the center of a gray background.

Figure 16B:
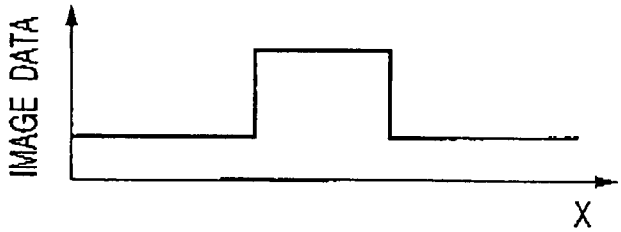

FIG. 16B shows the image data of a horizontal scanning period along a scanning line 16B—16B in FIG. 16A, wherein the abscissa indicates the horizontal position on the image and the ordinate indicates the magnitude of image data.

Figure 16C:
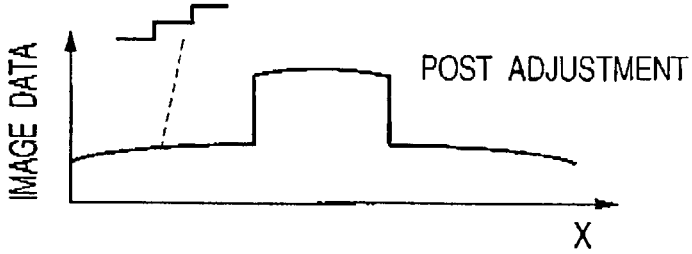

FIG. 16C shows the image data after adjustment on the image data shown in FIG. 16B, wherein the abscissa indicates the horizontal position on the image and the ordinate indicates the magnitude of image data.

Figure 16D:
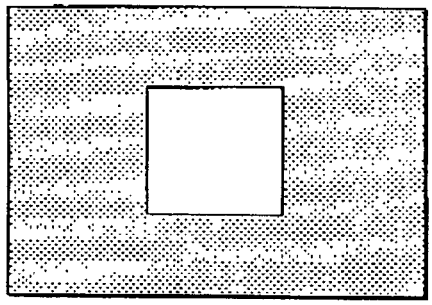

FIG. 16D shows the image obtained by modulation with the adjusted image data shown in FIG. 16C.

Figure 16E:
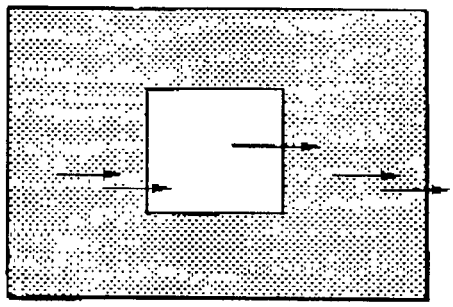

FIG. 16E shows a hindrance pattern generated when the white window pattern shown in FIG. 16A is moved in the horizontal direction.

As explained in FIG. 1, the image display apparatus of the present embodiment is provided with the scanning circuits 2, 2' on both ends of the scanning wirings of the display panel. Therefore the voltage drop in the scanning wiring becomes larger toward the center and also the adjustment data for the voltage drop become larger toward the center. Therefore the image data shown in FIG. 16B are adjusted for example to those shown in FIG. 16C.

However, though the aforementioned linear approximation executes very smooth adjustment, the pattern shown in FIG. 16C in magnified manner is composed of a stepwise pattern consisting of the minimum resolution of the modulation unit. The fact that the adjustment data are composed of such stepwise pattern was scarcely noticeable in the display of a stll image as shown in FIG. 16D (in case the number of gradation levels of the modulation unit is 8 bits).

On the other hand, when the white window pattern is continuous moved in the lateral direction as shown in FIG. 16E, there was visually confirmed that a vertical line pattern moved at the side of the window. Such vertical line pattern was generated by the aforementioned stepwise pattern of the adjustment data.

Since the present adjustment method is based on the calculation of the adjustment data for the voltage drop on the image data of the horizontal scanning period on real-time basis, the stepwise pattern also moves in the horizontal direction simultaneously with the continuous movement of the white window.

The vertical line pattern is visible in a moving image but not visible in a still image, because of the visual characteristics of human, showing higher visibility for a moving object than for a still object.

In the foregoing description, the number of gradation levels of the modulation unit is assumed to be 256, but such vertical line pattern may be recognized even in a still image if the number of gradation levels is selected as 64. Also in an image display apparatus with a higher luminance of light emission of the display panel, such pattern may become recognizable also in a still image because the luminance amount corresponding to a gradation level of the modulation unit becomes larger.

In consideration of the foregoing, the present inventors have confirmed that the vertical line-shaped hindrance pattern becomes unrecognizable by calculating the adjustment data with a higher precision and reducing the minimum resolution of the adjustment data.

In this embodiment, the adjustment data are calculated with 10 bits, and are converted by the dither method into the adjustment data of 8 bits showing pseudo gradation equivalent to 10 bits.

The vertical line-shaped hindrance pattern is scarcely noticeable by adding the adjustment data of 8 bits and the image data of 8 bits and executing modulation according to the result of such addition.

The aforementioned hindrance pattern is visible in case of displaying a special image as explained in the foregoing (particularly a small image with a high spatial frequency) but not recognizable in case of displaying ordinary television image.

However, the present inventors have confirmed that the feeling of aforementioned hindrance is generated in case of a computer-generated image or the like and have thought it important to provide an image without such unpleasant feeling even in such image. As the increase in the magnitude of hardware in such configuration is estimated to be not significant, the image display apparatus of the present embodiment is prepared including the aforementioned gray scale number converting unit.

The number of bits of the modulation unit is selected as 8 bit, while that of the image data is selected as 8 bits and that of the adjustment data prior to the conversion of the number of gradation levels is selected as 10 bits, but such selections are not restrictive.

Also in the present embodiment, the number of bits of the image data is selected as 8 bits and that of the modulation unit is selected as 8 bits, but such selections are not restrictive and the number of bits of the image data may be less than that of the modulation unit.

Also the number of bits of the adjustment data in the integral part thereof is selected as 8 bits, but the number of bits of the integral part may be suitably determined according to the magnitude of the adjustment data themselves.

For example, in case of using a display panel with a very large voltage drop, the adjustment data may exceed 255. In such case, the integral part may calculated with 9 bits.

In more general terms, the present embodiment includes the following configuration:

It is assumed that the number of bits of the modulation unit is K bits and that of the image data is K bits (K being an integer larger than 0):

(1) Based on the image data of K bits, there are calculated adjustment data of (k+L) bits (k, L being positive integers).

The image data have an integral part of K bits and a fractional part of 0 bits, while the adjustment data have an integral part of k bits and a fractional part of L bits.

(2) The adjustment data of (k+L) bits are subjected to the conversion of the number of gradation levels to obtain adjustment data of k bits.

The adjustment data of k bits after the conversion of number of gradation levels have an integral part of k bits and a fractional part of 0 bits, and are obtained by developing the fractional part of the adjustment data of (k+L) bits for example by the dither method thereby achieving conversion of the number of gradation levels into data of k bits.

(3) The image data of K bits and the adjustment data of k bits after the conversion of the number of gradation levels are added, in consideration of the aforementioned fractional point, thereby obtaining adjusted image data of K' bits.

(4) Modulation is executed according to the adjusted image data of K' bits.

In the foregoing step (1), the number of bits of the integral part of the adjustment data is selected as k bits (k being an integer larger than 0), and the value k can be suitably selected according to the maximum value of the adjustment data and may be equal to K (k=K).

For example, if the maximum value is 63 at the maximum adjustment, the integral part of the adjustment data can have 6 bits and need not be calculated with 8 bits as explained in the foregoing.

On the other hand, if the maximum value is 300 at the maximum adjustment, the integral part of the adjustment data have to have 9 bits.

(Third Embodiment)

Figure 17:
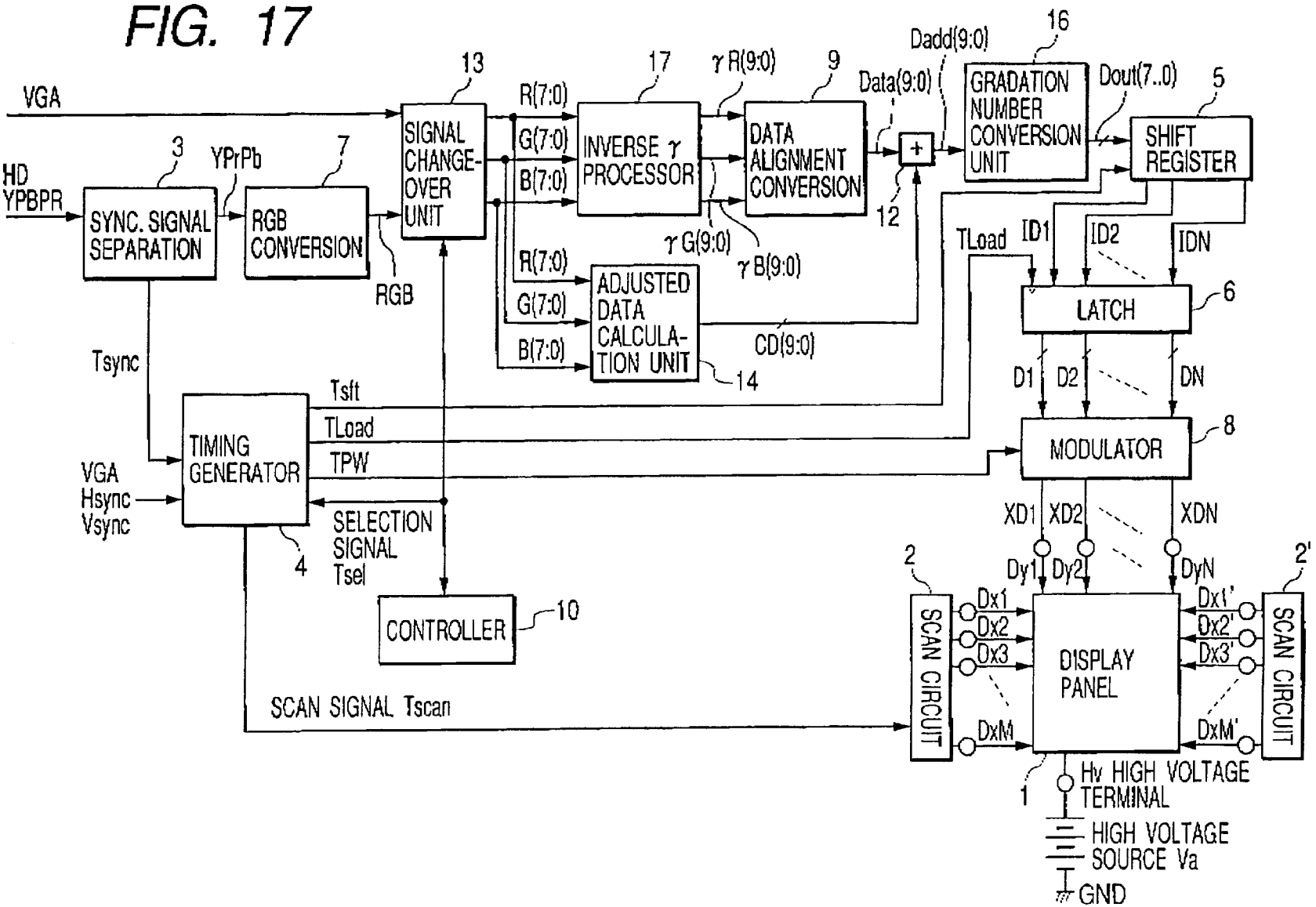
FIG. 17 is a block diagram of an image display apparatus embodying the present invention.
Figure 18:
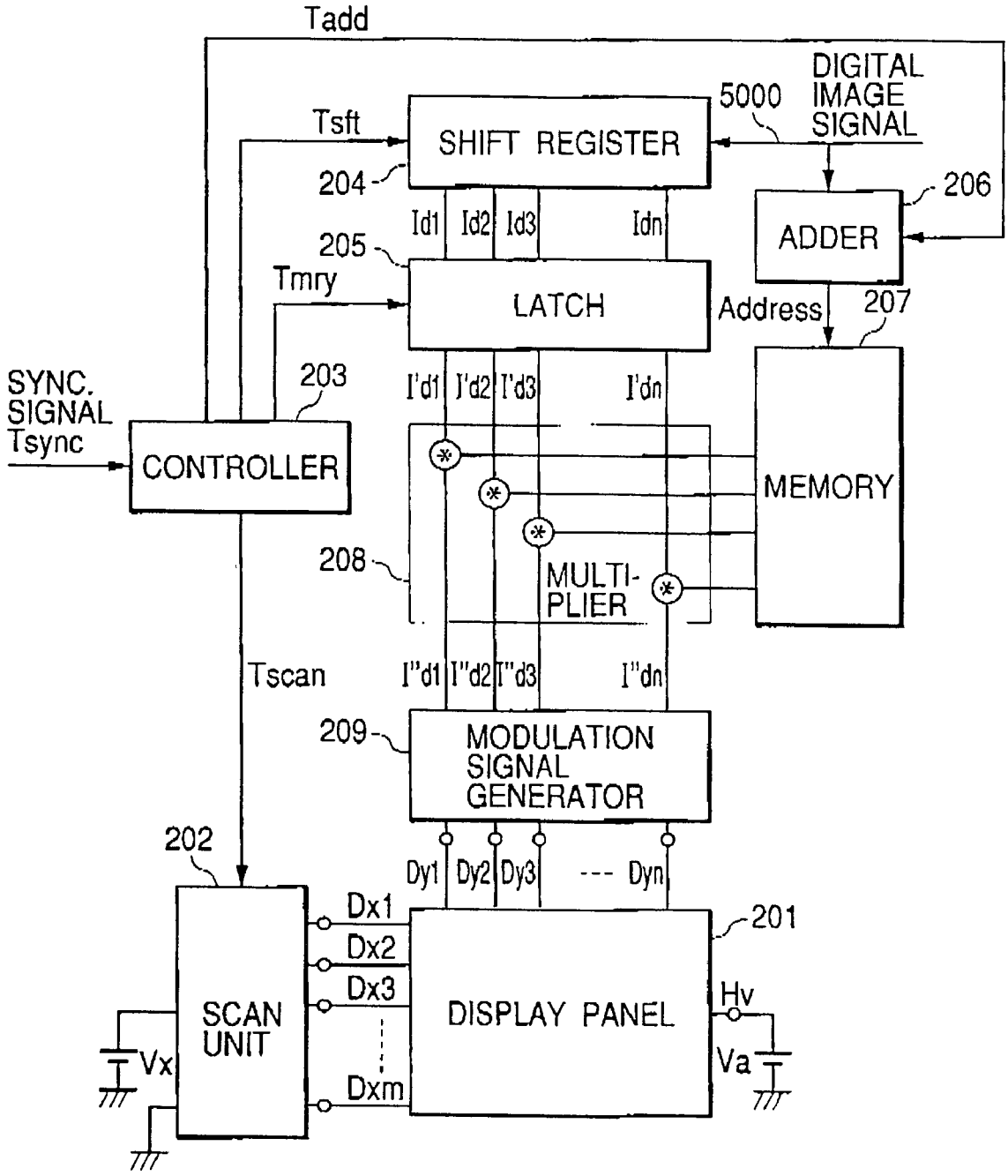
FIG. 18 is a schematic block diagram slowing the configuration of an image display apparatus of conventional technology.

FIG. 17 is a block diagram of an image display apparatus constituting a third embodiment of the present invention.

The third embodiment is different from the first embodiment in that:

(1) In order to execute the process of the inverse γ process unit, explained in the first embodiment, at a higher quality, it is composed of a memory with inputs of 8 bits and outputs of 10 bits.

(2) Image data of 10 bits and adjustment data of 10 bits are added with a 10-bit adder; and (3) 10-bit image data obtained by the addition are converted into 8 bits by the gray scale number converting unit. In this operation, the lower bits are developed by the dither method and are reflected in the upper 8 bits in order to achieve pseudo gradational representation of 10 bits.

In the present embodiment, the conversion of the number of gradation levels from the data of 10 bits into those of 8-bits by the dither method can be achieved as in the first embodiment by the method explained in FIGS. 14A and 14B.

Such image display apparatus is enabled, in the image displaying operation, to compensate the voltage drop in the scanning wiring encountered in the conventional technology and to reduce thus resulting deterioration of the displayed image, thereby providing very satisfactory image display.

Also an increase in the number of bits of the inverse γ-conversion process unit allows to reduce the error in the inverse γ-conversion process.

Furthermore, by adding the adjustment data calculated with 10 bits for the voltage drop and the image data of 10 bits after inverse γ-conversion and executing the conversion of the number of gradation levels from 10 bits to 8 bits on the result of such addition, there can be obtained excellent effects in comparison with an alternative configuration to be explained in the following.

As an alternative for the present embodiment, there can be conceived the following configuration in which:

(1) Image data of 10 bits subjected to inverse γ-conversion are subjected to a conversion of the number of gradation level from 10 bits to 8 bits;

(2) Adjustment data of 10 bits are subjected to a conversion of the number of gradation level from 10 bits to 8 bits; and (3) Adjustment is executed by adding the image data of 8 bits and the adjustment data of 8 bits after the conversion of the number of gradation levels.

In comparison with the above-described configuration, the configuration of the present embodiment is featured in executing the conversion of the number of gradation levels after the adding process, and is advantageous in that the addition process is executed with a higher precision to avoid the error in the calculation.

Also there can be obtained another effect, by converting the result of addition calculated with a higher precision by the gray scale number converting unit 16, of achieving display with pseudo gradational representation equivalent to 10 bits, thereby obtaining image display of higher quality.

In the present embodiment, the number of bits of the image data after inverse γ-conversion is selected as 10 bits, while that of the adjustment data is selected as 10 bits and that of the input signal to the modulation unit is selected as 8 bits, but such selections are not restrictive.

As explained in the foregoing, the present invention realizes excellent image quality by achieving compensation for the voltage drop, resulting from the electrical resistance of the wirings by a simple configuration.

What is claimed is:

1. An image display apparatus provided with:

plural image forming devices arranged in a matrix and connected to plural row wirings and plural column wirings;

scanning means connected to said row wirings and adapted for scanning said row wirings in succession; and modulation means connected to said column wirings, the apparatus comprising:

adjusted image data calculation means for calculating adjusted image data which are image data adjusted for the input image data;

wherein said adjusted image data calculation means is adapted to calculate said adjusted image data having a smooth distribution in the horizontal or vertical direction of the image for same non-zero image data input; and gray scale number conversion means for converting the number of gradation levels of said adjusted image data outputted by said adjusted image data calculation means;

wherein said modulation means outputs a modulation voltage signal to each column wiring based on the adjusted image data converted by said gray scale number conversion means.

2. An image display apparatus provided with:

plural image forming devices arranged in a matrix and connected to plural row wirings and plural column wirings;

scanning means connected to said row wirings and adapted for scanning said row wirings in succession; and modulation means connected to said column wirings, the apparatus comprising:

adjusted image data calculation means for calculating adjustment data having a smooth distribution in the horizontal or vertical direction of the image for same non-zero image data input;

gray scale number conversion means for converting the number of gradation levels of said adjusted image data; and addition means for adding the adjustment data subjected to the conversion of gradation levels and the input image data;

wherein said modulation means outputs a modulation voltage signal to each column wiring based on the output of said addition means.

3. An image display apparatus according to claim 1 or 2, wherein said gray scale number conversion means executes conversion of the number of gradation levels by area gradational modulation, in order to avoid discarding of the lower bits of the data at the entry of the adjustment data or the adjusted image data after the conversion of the number of gradation levels into the modulation means.

4. An image display apparatus according to claim 3, wherein said gray scale number conversion means executes conversion, based on said image data of k bits, of said adjustment data or said adjusted image data of (k+L) bits into data of k bits, wherein k and L are positive integers.

5. An image display apparatus according to claim 3, wherein said adjusted image data calculation means or said adjustment data calculation means is means for correcting, for the input image data, the influence of a voltage drop generated by the resistance of at least said row wirings.

6. An image display apparatus according to claim 3, wherein said adjusted image data or said adjustment data on a same row are smaller in the vicinity of the connection to said scanning means and larger as the distance from the connection to said scanning means increases.

7. An image display apparatus according to claim 3, wherein said area gradational modulation is dither modulation.

8. An image display apparatus according to claim 3, wherein:

said adjusted image data calculation means or said adjustment data calculation means has reference values discrete in the direction of magnitude of the image data, executes calculation of said adjusted image data or said adjustment data for the image data of magnitudes of said reference values and interpolation of the adjusted image data or adjustment data obtained in discrete manner in the direction of magnitude of the image data, thereby providing adjusted image data or adjustment data corresponding to the magnitude of the input image data.

9. An image display apparatus according to claim 8, wherein said adjusted image data calculation means or said adjustment data calculation means executes calculation of said adjusted image data or said adjustment data for discrete positions on a same row and interpolation of said adjusted image data or said adjustment data corresponding to the discrete positions, thereby providing adjusted image data or adjustment data corresponding to an arbitrary position.

10. An image display apparatus according to claim 9, wherein said modulation means is pulse width modulation means capable of modulating the pulse width according to gradation information.

11. An image display apparatus according to claim 3, wherein said display device is an electron emitting device for emitting electrons according to an applied modulation signal.

12. An image display apparatus according to claim 11, wherein said electron emitting device is a surface conduction electron-emitting device.

* * * * *

UNITED STATES PATENT AND TRADEMARK OFFICE

CERTIFICATE OF CORRECTION

PATENT NO. : 7,154,457 B2
APPLICATION NO. : 10/166641
DATED : December 26, 2006
INVENTOR(S) : Osamu Sagano et al.

It is certified that error appears in the above-identified patent and that said Letters Patent is hereby corrected as shown below:

COLUMN 3:

Line 32, “slowing” should read --showing--.
Line 43, “SCE)” should read --SCE).--.
Line 54, “width,” should read --width--.

COLUMN 5:

Line 16, “sore details,” should read --more detail,--.
Line 21, “front” should read --from--.
Line 29, “wirings” should read --wiring,--.
Line 51, “miniamperes” should read --milliamperes--.

COLUMN 6:

Line 4, “fin” should read --on--.
Line 20, “around” should read --amount--.
Line 52, “time.” should read --times.--.

COLUMN 7:

Line 13, “seL” should read --set--; and “5” should read --4--.
Line 16, “in” should read --*n*--.

COLUMN 9:

Line 6, “signal “F” should read --signal “H”--.
Line 25, “front” should read --from--.
Line 66, “SCR” should read --SCE--.

COLUMN 10:

Line 1, “omission” should read --emission--.
Line 56, “$Q1 = (Ie0 + Ie1)\times 64\Delta\times t\times 0.5$ (7)” should read
--$Q1 = (Ie0 + Ie1)\times 64\times\Delta t\times 0.5$ (7)--.
Line 60, “odder” should read --order--.

UNITED STATES PATENT AND TRADEMARK OFFICE

CERTIFICATE OF CORRECTION

PATENT NO. : 7,154,457 B2
APPLICATION NO. : 10/166641
DATED : December 26, 2006
INVENTOR(S) : Osamu Sagano et al.

It is certified that error appears in the above-identified patent and that said Letters Patent is hereby corrected as shown below:

COLUMN 11:

Line 25, “droop” should read --drop--.
Line 29, “1128” should read --128--.
Line 35, “ordinates” should read --ordinate--.
Line 48, “tie” should read --the--.
Line 55, “inustrates” should read --illustrates--.

COLUMN 12:

Line 17, “sane” should read --same--.

COLUMN 13:

Line 49, “Circuits 19)” should read --Circuit 19)--.
Line 53, “at” should read --of--.

COLUMN 14:

Line 25, “block,” should read --blocks,--.
Line 39, “horizontal.” should read --horizontal--.

COLUMN 15:

Line 15, “at” should read --a--.

COLUMN 16:

Line 1, “loss” should read --less--.
Line 40, “sane” should read --same--.

COLUMN 18:

Line 30, “stll” should read --still--.

UNITED STATES PATENT AND TRADEMARK OFFICE

CERTIFICATE OF CORRECTION

PATENT NO. : 7,154,457 B2
APPLICATION NO. : 10/166641
DATED : December 26, 2006
INVENTOR(S) : Osamu Sagano et al.

It is certified that error appears in the above-identified patent and that said Letters Patent is hereby corrected as shown below:

COLUMN 19:

Line 20, "8 bit," should read --8 bits,--.

Signed and Sealed this

Twentieth Day of May, 2008

JON W. DUDAS
*Director of the United States Patent and Trademark Office*